US010339754B1

(12) United States Patent
Halvorson

(10) Patent No.: US 10,339,754 B1
(45) **Date of Patent: *Jul. 2, 2019**

(54) GAMING SYSTEM AND METHOD HAVING INDEPENDENT, BUT INTERLEAVED REEL SETS

(71) Applicant: ADP GAUSELMANN GMBH, Espelkamp OT (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/020,157

(22) Filed: Jun. 27, 2018

(51) Int. Cl.
*G07F 17/32* (2006.01)

(52) U.S. Cl.
CPC ..... *G07F 17/3213* (2013.01); *G07F 17/326* (2013.01); *G07F 17/3216* (2013.01)

(58) Field of Classification Search
USPC ..... 463/43
See application file for complete search history.

(56) References Cited

U.S. PATENT DOCUMENTS

| | | | | |
|---|---|---|---|---|
| 9,710,998 | B2 * | 7/2017 | Nelson | G07F 17/3211 |
| 9,922,497 | B2 * | 3/2018 | Joung | G07F 17/3244 |
| 2016/0328909 | A1 * | 11/2016 | Joung | G07F 17/326 |
| 2018/0204410 | A1 * | 7/2018 | Joung | G07F 17/326 |

* cited by examiner

*Primary Examiner* — Pierre E Elisca
(74) *Attorney, Agent, or Firm* — Resolute Legal PLLC

(57) ABSTRACT

Various embodiments of a gaming system and method are disclosed as generating a plurality of independent symbol sets that are interleaved, but can be evaluated separately and together to create new ways to win awards.

20 Claims, 15 Drawing Sheets

GAMING SYSTEM AND METHOD HAVING INDEPENDENT, BUT INTERLEAVED REEL SETS

FIELD OF THE INVENTION

The present disclosure relates to gaming devices.

BACKGROUND OF THE INVENTION

Gaming machines that accept wagers in exchange for the opportunity to win awards or prizes are known. Game machines that offer new ways to win awards or prizes are needed to gain and retain players' interest in the gaming machines.

SUMMARY OF THE INVENTION

Various embodiments of a gaming system and method are disclosed as generating a plurality of independent symbol sets that are interleaved, but can be evaluated separately and together to create new ways to win awards.

In some embodiments with two independent symbol sets, the gaming system generates alternating columns of symbols from the two independent symbol sets (e.g., the generated columns of symbols alternate between symbols from a first independent symbol set and symbols from a second independent symbol set). In one embodiment, starting with a first column of symbols, the gaming system evaluates every other column of symbols, each of the columns being associated with the first independent symbol set, for winning symbol combinations and awards based on a first pay table. In one embodiment, starting from the second column of symbols, the gaming system may also evaluate every other column of symbols, each of the columns being associated with the second independent symbol set, for winning symbol combinations and awards based on a second pay table. In some embodiments, the gaming system may evaluate all of the columns of symbols (e.g., symbols associated with the first independent symbol set and the second independent symbol set) together for winning symbol combinations and awards based on a third pay table.

In some embodiments, the columns of the first independent symbol set are different from the columns of the second independent symbol set. In some embodiments, at least one of the columns of the second independent symbol set includes more symbols than the columns of the first independent symbol set. In some embodiments, all of the columns of the second independent symbol set include more symbols than all of the columns of the first independent symbol set. In some embodiments, the second independent symbol set includes fewer columns than columns of the first independent symbol set. In some embodiments, the second independent symbol set includes one fewer columns than columns of the first independent symbol set. However, is should be appreciated that in some embodiments, the symbols in the first independent symbol set can be the same as symbols from the second independent symbol set.

In some embodiments, at least one of the symbols from the first independent symbol set and at least one of the symbols from the second independent symbol set are different. In some embodiments, a plurality of the symbols from the first independent symbol set and a plurality of the symbols from the second independent symbol set are different. In some embodiments, all of the symbols from the first independent symbol set and all of the symbols from the second independent symbol set are different. In some embodiments, the at least one of the different symbols from the first independent symbol set and at least one of the different symbols from the second independent symbol set are associated with each other. In some embodiments, the association between these different symbols cause the gaming system to provide an enhanced award when these different symbols are displayed in specific positions relative to each other.

In one embodiment of the gaming system and method, the gaming system includes a plurality of symbol display areas associated with a plurality of video based slot machine reels. For example, the gaming system may include a first set of five video based slot machine reels (e.g., the first set of reels) that are each associated with three visible symbol display areas. For a play of the game, for each of the first set of reels, the gaming system randomly generates a first plurality of symbols for the symbol display areas of the first set of reels. The gaming system generates the first plurality of symbols based on a plurality of symbol combinations of a first set of symbols. The gaming system evaluates the generated symbols on the first set of reels for winning symbol combinations. The gaming system determines a payout amount based on winning symbol combinations along wagered pay lines for the first set of reels. The gaming system may also include a second set of four video based slot machine reels (e.g., the second set of reels) that are each associated with four visible symbol display areas. For each of the second set of reels, the gaming system generates a second plurality of symbols for the symbol display areas of the second set of reels. The gaming system generates the second plurality of symbols based on symbol combinations of a second set of symbols. The gaming system evaluates the generated second plurality of symbols on the second set of reels for winning symbol combinations along wagered pay lines. In some embodiments, the gaming system also evaluates the generated first and second plurality of symbols together for winning symbol combinations along wagered pay lines for the combined first and second sets of reels. In some embodiments, the gaming system displays the first plurality of symbols for the first set of reels substantially simultaneously with the second plurality of symbols for the second set of reels. In some embodiments, the gaming system displays the first plurality of symbols for the first set of reels prior to displaying the second plurality of symbols for the second set of reels.

In one embodiment, the gaming system generates and displays the reels of the first and second sets of reels alternating between a reel of the first set of reels and a reel of the second set of reels. In some embodiments where the reels are alternating between the two sets of reels, when the gaming system determines awards for symbols of the first set of reels alone, the awards are not based on symbols displayed on adjacent reels. Similarly, in some embodiments where the reels are alternating between the two sets of reels, when the gaming system determines awards for symbols of the second set of reels alone, the awards are not based on symbols displayed on adjacent reels. However, in embodiments where the reels are alternating between the two sets of reels, when the gaming system determines awards for the combined symbols from the first and second set of reels, the awards are based on symbols of adjacent reels. In some embodiments, the gaming system substantially hides at least one or more of the second set of reels behind the first set of reels, but reveals a portion of the one or more second set of reels between two reels of the first set of reels. In some embodiments, the gaming system substantially hides at least one or more of the first set of reels behind the second set of reels, but reveals a portion of the one or more first set of reels between two reels of the second set of reels.

In some embodiments, the number of visible rows of symbols of the first set of reels is not the same as the number of visible row symbols of the second set of reels where the visible rows of symbols of the first set of reels are offset from the visible rows of symbols of the second set of reels. In some such embodiments where the gaming system evaluates pay lines based on a combination of symbols from the first and second set of reels, the gaming system may evaluate a plurality of different substantially horizontal pay lines starting from one symbol, but the plurality of different substantially horizontal pay lines span across different symbol combinations.

In one embodiment, the gaming system provides the second set of reels for a play of the game based on a player's wager. For example, if the player's wager is equal to or greater than a first predetermined threshold wager, the gaming system automatically includes the second set of reels for a play of the game. In some embodiments, the gaming system also evaluates the symbols of the combined first set of reels and second set of reels when the second set of reels is included in a play of the game. In some embodiments, the evaluation of the symbols of the combined first and second set of reels requires a wager to be equal to or greater than a second predetermined threshold wager. In some embodiments, the second predetermined threshold wager is different from the first predetermined threshold wager. In some embodiments, the second predetermined threshold wager is greater than the first predetermined threshold wager. In some embodiments, the player must actively select the second set of reels for a play of the game. In one such embodiment, the gaming system receives a player input from an input device, such as a player pressing a software button on a touch screen or a player pressing a hardware button, to select either a play of only the first set of reels or a play of the game including the second set of reels (or "additional reel set" for the embodiments with a plurality of video based slot machine reels). In some embodiments, only if the play of the game includes the second set of reels will the processor determine any awards based on symbols from the second set of reels. In some embodiments, only if the play of the second set of reels has been selected will the processor determine any awards based on the combined symbols from the first and second set of reels.

By enabling the player to access a second set of reels for a play of a game, a gaming system can provide many new ways to obtain more and greater awards, which enhances players' excitement for a game. The new potential to improve or earn greater awards creates a greatly improved sense of anticipation for players.

DETAILED DESCRIPTION OF THE INVENTION

Figure 1:
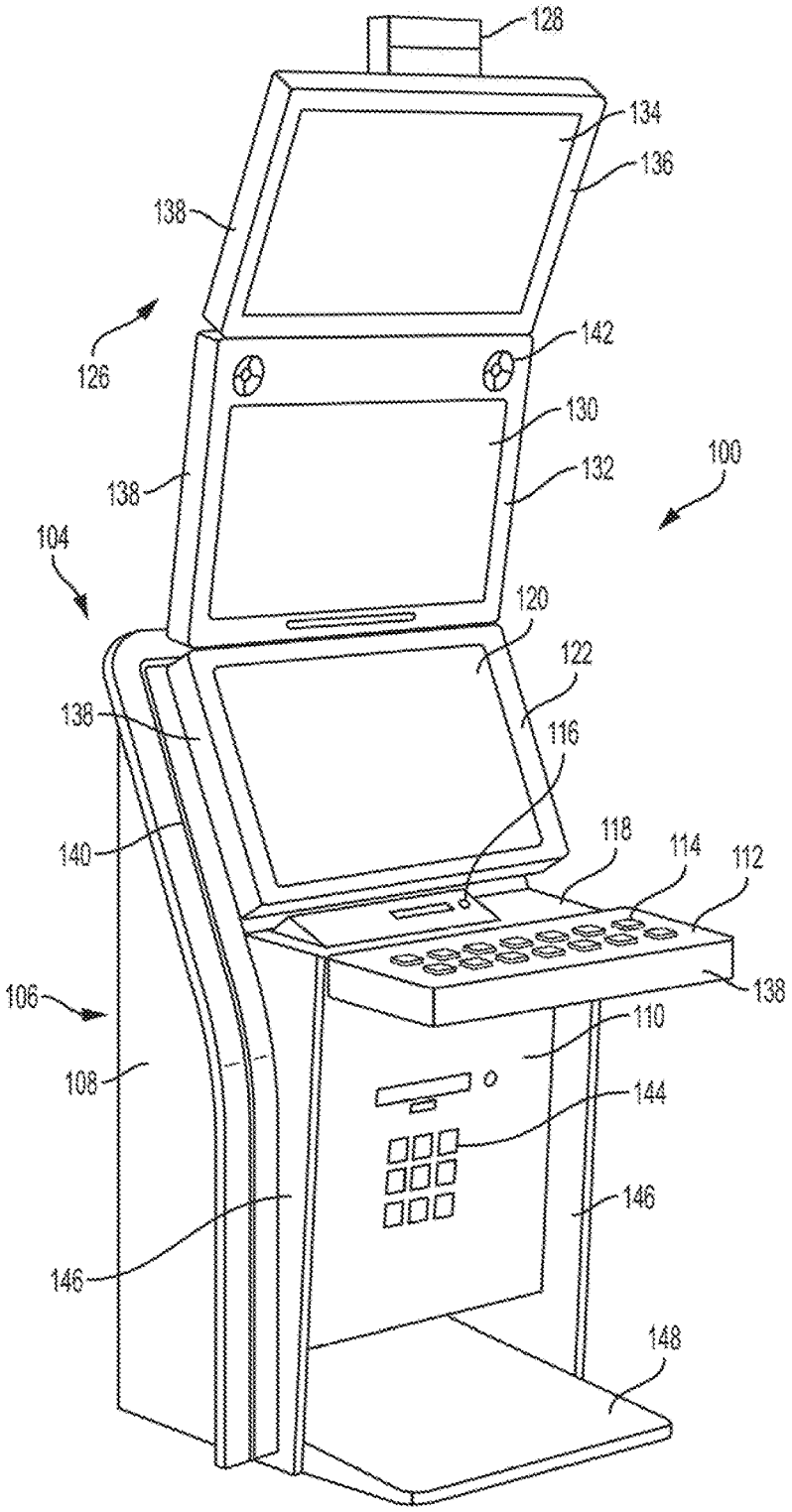
FIG. 1 is a perspective view of one embodiment of a stand-alone gaming device of a gaming system.

Various embodiments of a gaming system and method are disclosed as generating a plurality of independent symbol sets that are interleaved, but can be evaluated separately and together to create new ways to win awards.

In some embodiments with two independent symbol sets, the gaming system generates alternating columns of symbols from the two independent symbol sets (e.g., the generated columns of symbols alternate between symbols from a first independent symbol set and symbols from a second independent symbol set). In one embodiment, starting with a first column of symbols, the gaming system evaluates every other column of symbols, each of the columns being associated with the first independent symbol set for winning symbol combinations and awards based on a first pay table. In one embodiment, starting from the second column of symbols, the gaming system may also evaluate every other column of symbols, each of the columns being associated with the second independent symbol set for winning symbol combinations and awards based on a second pay table. In some embodiments, the gaming system may evaluate all of the columns of symbols (e.g., symbols associated with the first independent symbol set and the second independent symbol set) together for winning symbol combinations and awards based on a third pay table.

In some embodiments, the columns of the first independent symbol set are different from the columns of the second independent symbol set. In some embodiments, at least one of the columns of the second independent symbol set includes more symbols than the columns of the first independent symbol set. In some embodiments, all of the columns of the second independent symbol set include more symbols than all of the columns of the first independent symbol set. In some embodiments, the second independent symbol set includes fewer columns than columns of the first independent symbol set. In some embodiments, the second independent symbol set includes one fewer column than columns of the first independent symbol set. However, is should be appreciated that in some embodiments, the symbols in the first independent symbol set can be the same as symbols from the second independent symbol set.

In some embodiments, at least one of the symbols from the first independent symbol set and at least one of the symbols from the second independent symbol set are different. In some embodiments, a plurality of the symbols from the first independent symbol set and a plurality of the symbols from the second independent symbol set are different. In some embodiments, all of the symbols from the first independent symbol set and all of the symbols from the second independent symbol set are different. In some embodiments, the at least one of the different symbols from the first independent symbol set and at least one of the different symbols from the second independent symbol set are associated with each other. In some embodiments, the association between these different symbols cause the gaming system to provide an enhanced award when these different symbols are displayed in specific positions relative to each other.

In one embodiment of the gaming system and method, the gaming system includes a plurality of symbol display areas associated with a plurality of video based slot machine reels.

For example, the gaming system may include a first set of five video based slot machine reels (e.g., the first set of reels) that are each associated with three visible symbol display areas. For a play of the game, for each of the first set of reels, the gaming system randomly generates a first plurality of symbols for the symbol display areas of the first set of reels. The gaming system generates the first plurality of symbols based on a plurality of symbol combinations of a first set of symbols. The gaming system evaluates the generated symbols on the first set of reels for winning symbol combinations. The gaming system determines a payout amount based on winning symbol combinations along wagered pay lines for the first set of reels. The gaming system may also include a second set of four video based slot machine reels (e.g., the second set of reels) that are each associated with four visible symbol display areas. For each of the second set of reels, the gaming system generates a second plurality of symbols for the symbol display areas of the second set of reels. The gaming system generates the second plurality of symbols based on symbol combinations of a second set of symbols. The gaming system evaluates the generated second plurality of symbols on the second set of reels for winning symbol combinations along wagered pay lines. In some embodiments, the gaming system also evaluates the generated first and second plurality of symbols together for winning symbol combinations along wagered pay lines for the combined first and second sets of reels. In some embodiments, the gaming system displays the first plurality of symbols for the first set of reels substantially simultaneously with the second plurality of symbols for the second set of reels. In some embodiments, the gaming system displays the first plurality of symbols for the first set of reels prior to displaying the second plurality of symbols for the second set of reels.

In one embodiment, the gaming system generates and displays the reels of the first and second sets of reels alternating between a reel of the first set of reels and a reel of the second set of reels. In some embodiments where the reels are alternating between the two sets of reels, when the gaming system determines awards for symbols of the first set of reels alone, the awards are not based on symbols displayed on adjacent reels. Similarly, in some embodiments where the reels are alternating between the two sets of reels, when the gaming system determines awards for symbols of the second set of reels alone, the awards are not based on symbols displayed on adjacent reels. However, in embodiments where the reels are alternating between the two sets of reels, when the gaming system determines awards for the combined symbols from the first and second set of reels, the awards are based on symbols of adjacent reels. In some embodiments, the gaming system substantially hides at least one or more of the second set of reels behind the first set of reels, but reveals a portion of the one or more second set of reels between two reels of the first set of reels. In some embodiments, the gaming system substantially hides at least one or more of the first set of reels behind the second set of reels, but reveals a portion of the one or more first set of reels between two reels of the second set of reels.

In some embodiments, the number of visible rows of symbols of the first set of reels is not the same as the number of visible row symbols of the second set of reels where the visible rows of symbols of the first set of reels are offset from the visible rows of symbols of the second set of reels. In some such embodiments where the gaming system evaluates pay lines based on a combination of symbols from the first and second set of reels, the gaming system may evaluate a plurality of different substantially horizontal pay lines starting from one symbol, but the plurality of different substantially horizontal pay lines span across different symbol combinations.

Gaming System Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device;

gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
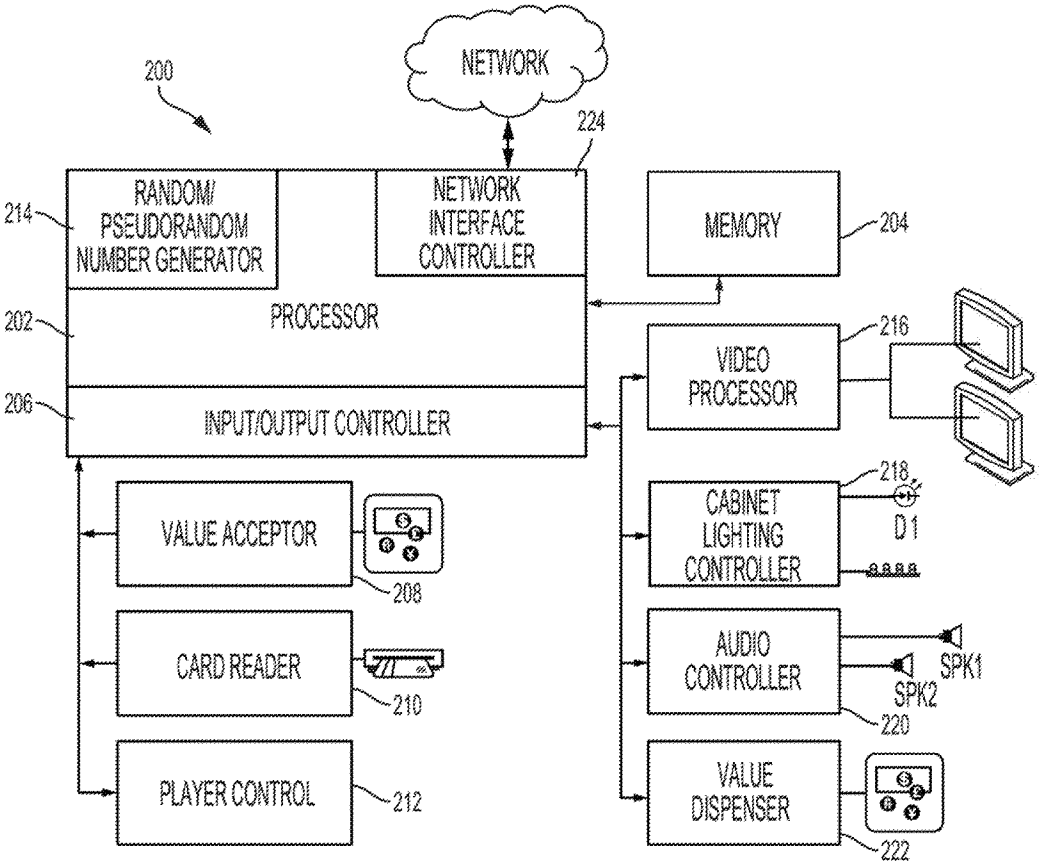
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202. In some embodiments, the random number generator may be located in a central server or a server that is remote from the gaming device 100. The gaming device 100 may receive the randomly generated values from the central server or remote server.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Operation

Figure 3A:
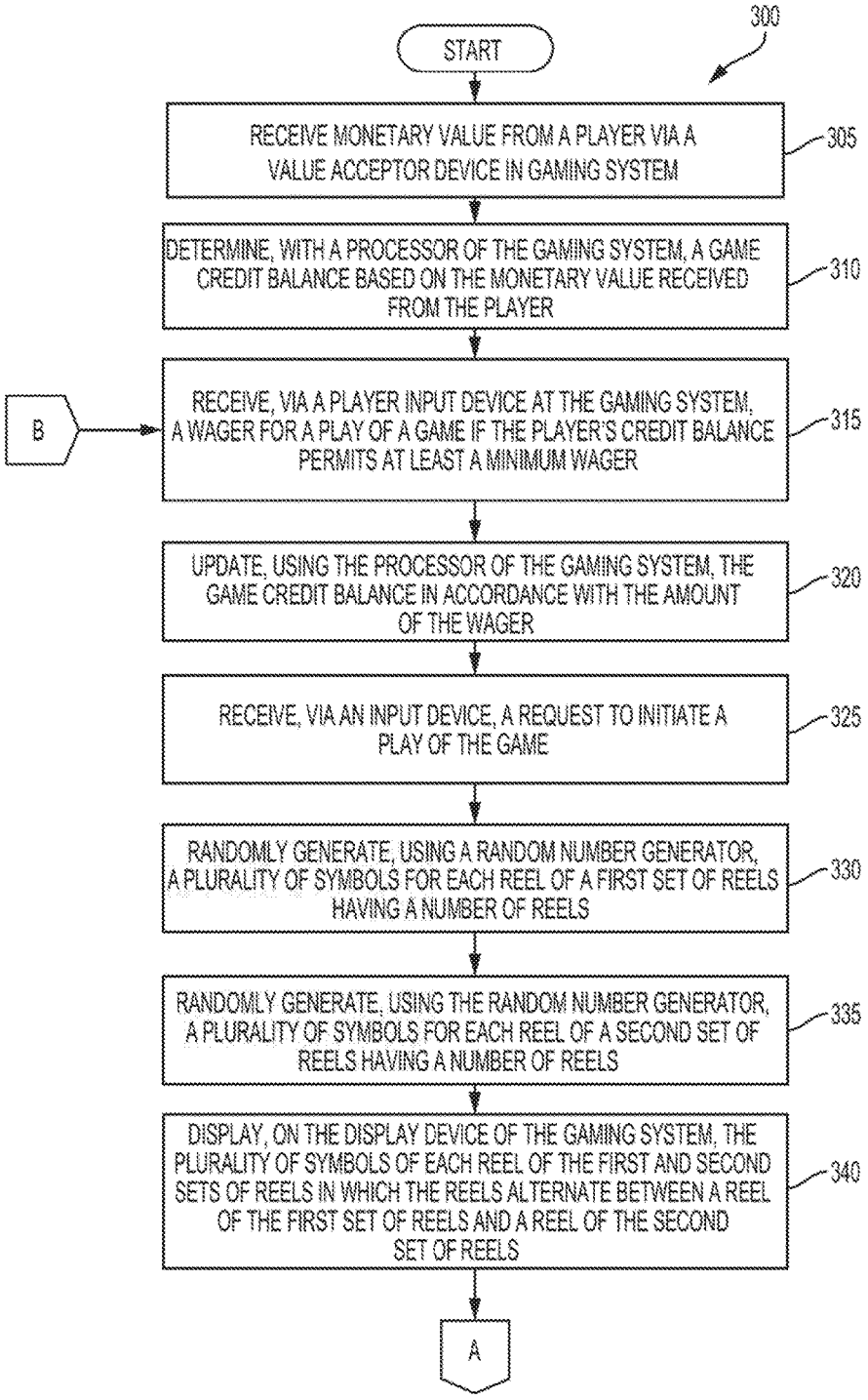
FIGS. 3A, 3B, and 3C illustrate one embodiment of a method of operating the gaming system having independent symbol sets that are interleaved, but can be evaluated separately and together.
Figure 3B:
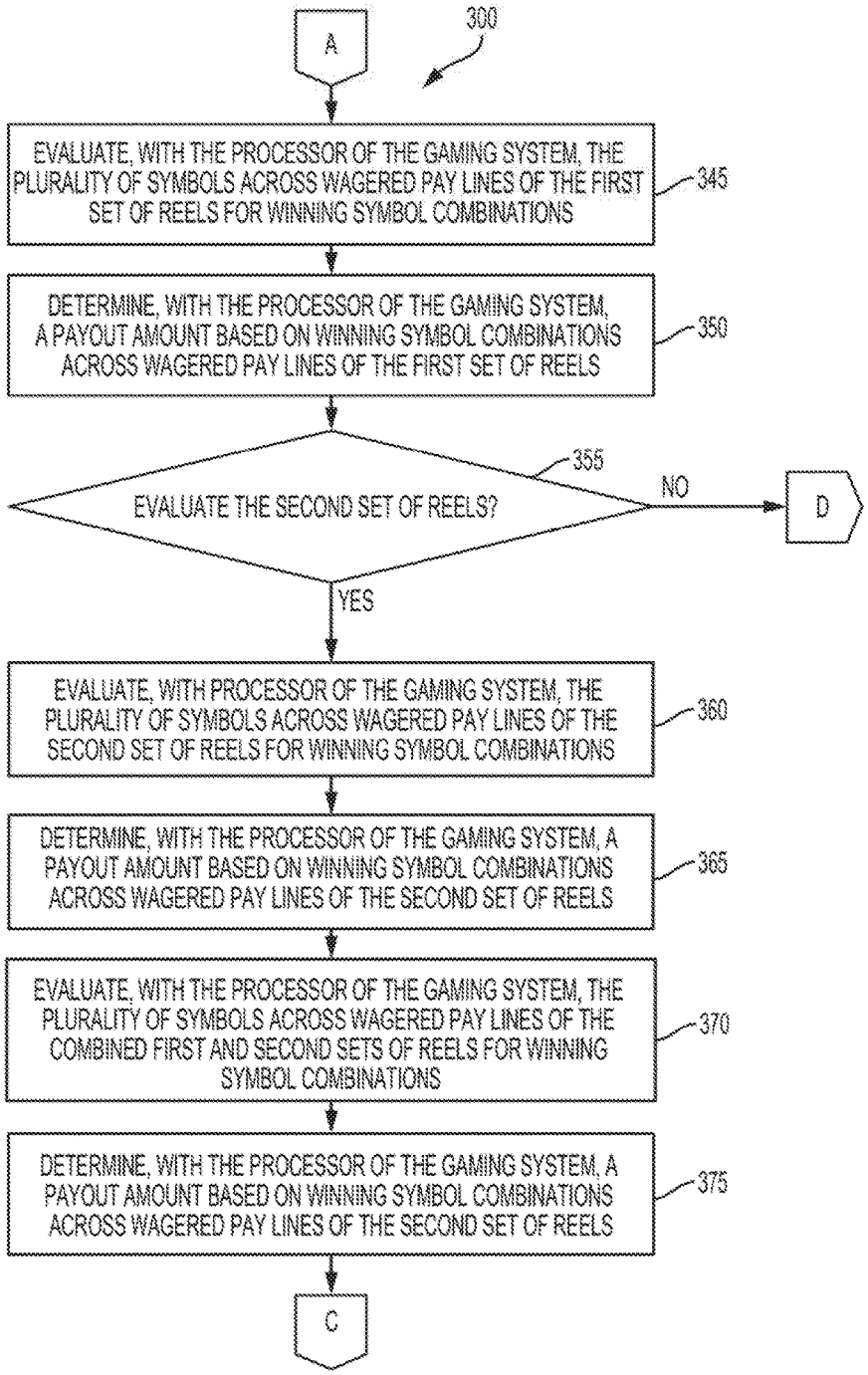
Figure 3C:
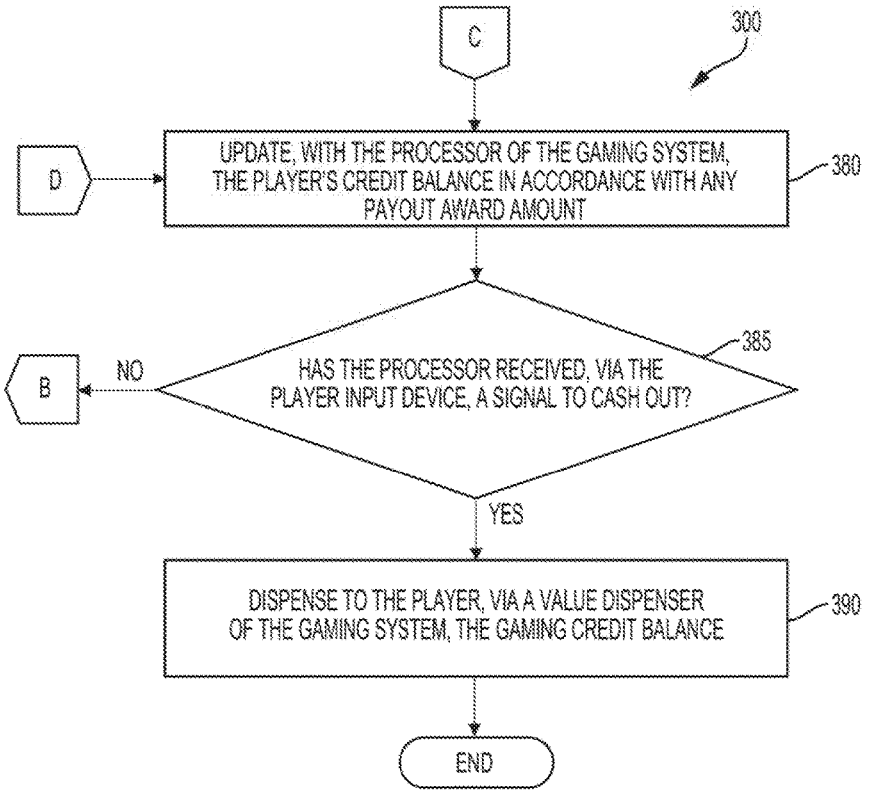

FIGS. 3A, 3B, and 3C illustrate a flowchart of an example operation 300 of one embodiment of the gaming system and method.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions (e.g., symbol display areas) on reels in a game in which to place wagers. Although in some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system. In some embodiments, the player's wager level determines whether the gaming system will provide the player with access to a first set of reels and a second set of reels for a play of the game. In some embodiments, a wager below a predetermine threshold causes the gaming system to restrict a play of the game to a first set of reels.

In some embodiments, the player must place a wager that meets a predetermined threshold before the gaming system enables a second set of reels for the player. It should be appreciated that in some embodiments the gaming system displays the second set of reels for a play of the game regardless of whether the player provided a wager meeting the predetermined threshold. However, for wagers below the predetermined threshold, the gaming system does not use the second set of reels to create awards for the player in some embodiments. In some embodiments, the gaming system is not configured with a predetermined threshold wager and the gaming system provides both the first set of reels and the second set of reels for a play of the game for any suitable wager. In some embodiments, the gaming system may require the player to actively provide input to select to play the second set of reels (e.g., through a button selection, or some other suitable manner).

In some embodiments, the first set of reels and the second set of reels are each independent sets of reels. The first set of reels is independent of the second set of reels because the first set of reels can be evaluated independently of the second set of reels for purposes of determining an award. The second set of reels is independent of the first set of reels because the second set of reels can be evaluated independently of the first set of reels for purposes of determining an award. The first set of reels and the second set of reels can also be evaluated together for purposes of determining an award.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a first plurality of symbols as indicated in block 330. In some embodiments, the first plurality of symbols is based on symbol combinations from a first set of symbols. In some embodiments, the gaming system may generate the first plurality of symbols for display on a first set of reels. In some such embodiments, each reel is associated with its own set of symbols (based on the first set of symbols). As used herein, the random number generation may refer to pseudo-random or true-random number generation depending on the module used for the random number generation.

In one embodiment, the gaming system may use the random number generator to randomly generate a second plurality of symbols as indicated in block 335. In some embodiments, the second plurality of symbols is based on symbol combinations from a second set of symbols. In some embodiments, the gaming system may generate the second plurality of symbols for display on a second set of reels. In some such embodiments, each reel is associated with its own set of symbols (based on the second set of symbols).

In some embodiments, the first symbol set includes one or more symbols that are different from one or more symbols in the second symbol set. In some embodiments, all of the symbols in first symbol set includes symbols that are different from all of the symbols in the second symbol set. In some embodiments, the first symbol set has some symbols that are the same as some of the symbols in the second symbol set. In some embodiments for which the first symbol set has symbols that are different from the symbols in the second symbol set, at least some of the different symbols in the first symbol set have associated symbols in the second symbol set for determining an award. An example of such association of different symbols is an association between certain of alphabet letter symbols and numeric symbols. In one such embodiment, an A symbol is associated with a 1 symbol, a B symbol is associated with a 2 symbol, a C symbol is associated with a 3 symbol, and so on. Another example of such association of different symbols may be common or related themes, such as a hunting theme. In one such example, a symbol of a bird is associated with a symbol of a shotgun, a symbol of a deer is associated with a symbol of a rifle, a symbol of a fish is associated with a symbol of a fishing pole, and so on.

In one embodiment, the gaming system may cause a display device to display the generated first plurality of symbols and the generated second plurality of symbols as indicated in block 340. In a game using reels, the gaming system may display the generated first plurality of symbols on the visible display areas of the first set of reels and the generated second plurality of symbols on the visible display areas of the second set of reels. The reels may be displayed on the display device as interleaved such that the reels alternate between a reel of the first set of reels and a reel of the second set of reels. In some embodiments, the first set of reels has a number of reels that is one more than the number of reels of the second set of reels. In some embodiments, each of the reels of the first set of reels is spaced from another reel of the first set of reels such that at least one of the reels of the second set of reels is displayed between two reels of the first set of reels. This creates a display of the reels alternating between a reel of the first set of reels and a reel of the second set of reels. In some embodiments in which one of the reels of the second set of reels is located between two reels of the first set of reels, only a portion of the reel of the second set of reels is displayed such that the second set of reels located behind the first set of reels. In some embodiments, the reels of the second set of reels are shown in their entirety and only a portion of each reel of the first set of reels are displayed at least partially hidden behind reels of the second set of reels. The process of operation 300 continues to block 345 via off page connector A in FIG. 3B.

Turning now to FIG. 3B and off page connector A, in one embodiment as shown in block 345, the gaming system evaluates the generated first plurality of symbols across active or wagered pay lines of the first set of reels for winning symbol combinations. In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment, the gaming system determines an award amount based on winning symbol combinations formed across the reels of first set of reels on active pay lines. For example, if a first reel set pay table (the pay table for the first set of reels) associated with the gaming system indicated that at least three of the same letter A symbols is a winning symbol combination and awards a predetermined payout, the gaming system would evaluate the generated plurality of symbols for letter A symbols. If the gaming system generated at least three letter A symbols on the first three reels of the first set of reels and along an active pay line, the gaming system may determine that the three letter A symbols is a winning symbol combination based on the predetermined pay table. It should be noted for the embodiment in which the reels alternate between a reel of the first set of reels and a reel of the second set of reels, the winning symbol combinations for the first set of reels are not formed across adjacent reels; rather, the winning symbol combination are formed across every other reel. It should be appreciated that a pay table may include any suitable number of winning symbol combinations and awards. In one embodiment, a pay table may indicate that as few as one symbol may be associated with an award. Alternatively, two or more symbols may be used to form winning symbol combinations that result in an award.

In block 350, the gaming system determines, with the processor, an award or payout amount based on the evaluated winning symbol combinations across wagered pay lines of the first set of reels. Although not illustrated in the flow diagram immediately following block 350, the gaming system may update in some embodiments, with the processor, the player's gaming credit balance in accordance with any award amount based on winning symbol combinations across pay lines of the first set of reels. It should be appreciated that in some embodiments where a threshold wager to enable play on a second set of reels has been received, the gaming system may delay determination of an award amount for the first set of reels until an evaluation of the second set of reels (explained more fully hereinbelow). As noted above, the blocks illustrated in FIGS. 3A-3C can be rearranged in any suitable order. As such, it should be appreciated that the gaming system may determine an award or payout amount based on evaluated winning symbol combinations across wager pay lines for the first set of reels later in operation 300 at other suitable times.

As indicated earlier in block 315, the gaming system may determine, based on the player's wager or a received a selection from the player, whether to execute a play the game with the first set of reels or to execute a play the game with the first set of reels and the second set of reels. In the situation for which the gaming system received a signal to play the game with only the first set of reels, as illustrated in block 355 (i.e., the gaming system did not receive a threshold wager for the second set of reels), operation 300 moves to block 380 in FIG. 3C via off page connector D.

Continuing to FIG. 3C, block 380 illustrates that the gaming system may update, with the processor, the player's gaming credit balance in accordance with any award amount based on winning symbol combinations across pay lines for the first set of reels.

In one embodiment, as indicated in block 385, the gaming system may receive a signal to end game play or "cash out" via an input device of the gaming system. In such a situation, the gaming system dispenses a value to the player, through a value dispenser, based on the player's gaming credit balance as illustrated in block 390 and operation 300 ends.

On the other hand, if the gaming system processor has not received a signal to end game play via the player input device, operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

Returning to block 355, in some embodiments the gaming system received a threshold wager for activation of the second set of reels. In such an embodiment where the gaming system received a signal to play the game with the second set of reels, as illustrated in block 355, operation 300 moves to block 360. The gaming system evaluates the generated second plurality of symbols across active or wagered pay lines of the second set of reels for winning symbol combinations. In some embodiments, the gaming system performs the evaluation using a pay table that is different from the pay table used to evaluate the first plurality of symbols on the first set of reels. In some embodiments, the different pay table may be necessary when the symbols available for generation and display on the second set of reels are different from symbols available for generation and display on the first set of reels.

In one embodiment, the gaming system determines whether to perform an evaluation of the second set of symbols based on the player's wager or the player selection of the second set of symbols, the gaming system may save memory and processor usage when the gaming system does not evaluate the second set of symbols. The reduced memory and processor usage may reduce the gaming system's power consumption, making the gaming system more efficient. It should be appreciated that in some embodiments, the gaming system evaluates the second plurality of symbols on the second set of reels regardless of whether the player is entitled to an award based on the second plurality of symbols. In some such embodiments, the gaming system may show the player positive results from the evaluation of the second plurality of symbols to show the player what the player missed by not playing the second set of reels for the play of the game. This may provide the necessary level of excitement and anticipation to convince the player to play the second set of reels for the play of the game.

In one embodiment, the gaming system evaluates the second plurality of symbols for winning symbol combinations based on the pay lines wagered upon by a player. The gaming system may evaluate the player selected pay lines, gaming system assigned pay lines, or pay lines assigned as active in some other manner for the play of the game. In one embodiment using reels, the gaming system determines an award amount based on winning symbol combinations formed across the reels of the second set of reels on active pay lines. It should be noted for the embodiments in which the reels alternate between a reel of the first set of reels and a reel of the second set of reels, the winning symbol combinations for the second set of reels are not formed across adjacent reels; rather, the winning symbol combination are formed across every other reel. It should be appreciated that a pay table may include any suitable number of winning symbol combinations and awards. In one embodiment, a pay table may indicate that as few as one symbol may be associated with an award. Alternatively, two or more symbols may be used to form winning symbol combinations that result in an award.

In block 365, the gaming system determines, with the processor, a payout amount based on the evaluated winning symbol combinations across wagered pay lines of the second set of reels. As noted above, the blocks illustrated in FIGS. 3A-3C can be rearranged in any suitable order. As such, it should be appreciated that the gaming system may determine a payout amount based on the evaluated winning symbol combinations across wagered pay lines for the second set of reels at other suitable times.

In one embodiment, as indicated in block 370, the gaming system also evaluates the generated first and second plurality of symbols for winning symbol combinations across active or wagered pay lines of the combined first set of reels and the second set of reels. In some embodiments, the gaming system requires a third predetermined threshold wager before making this third evaluation available. It should be appreciated that the wagers necessary to obtain the evaluation of the first set of reels, the second set of reels, and a combination of the first and second set of reels can be combined into one single initial wager. In other embodiments, the gaming system may enable the player to place one or more separate wagers and enable the separate wagers to be placed a different times before or during a play of the game.

For this evaluation of winning symbol combination, the gaming system evaluates the generated symbols of all the reels of the first set of reels and the second set of reels concurrently based on a third pay table. In some embodiments, the third pay table is different from the first pay table (for the first set of reels) and different from the second pay table (for the second set of reels). For the embodiments in which the reels alternate between a reel of the first set of reels and a reel of the second set of reels, the winning combination are formed across adjacent reels, not taking in account whether the reels are reels of the first set of reels or reels of the second set of reels. In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

In one embodiment where the gaming system evaluates the generated symbols of all the reels of the first set of reels and the second set of reels together, at the conclusion of the evaluation, the gaming system may determine a payout amount based on winning symbol combinations across wagered pay lines of the combined first and second sets of reels, as illustrated in block 375. After the gaming system makes the determination, operation 300 moves, via off page connector C, to FIG. 3C and block 380.

It is noted that blocks 360, 365, 370 and 375 are depicted as optional, depending on the player's optional wager or the player's selection (or both). However, it should be appreciated that blocks 360, 365, 370 and 375 may be integrated as part of a game without the player having to select an optional feature of the game or place an additional wager for the gaming system to activate and evaluate all reel sets and symbol combinations.

Returning to operation 300, off page connector C continues to block 380 in FIG. 3C. In block 380, the gaming system may update, with the processor, the player's gaming credit balance in accordance with any award amount based on winning symbol combinations across pay lines for which the gaming credit balance have not previous updated. In some embodiments, the gaming system may have previously updated the player's gaming credit balance with the award amount based on winning symbol combinations from the first set of reels and the award amount based on winning symbol combinations from the second set of reels. Hence, the gaming system may need to update the player's gaming credit balance with the award amount based on winning symbol combinations from the evaluation of the combined symbols from the first and second sets of reels.

In one embodiment, as indicated in block 385, the gaming system may receive a signal to end game play or "cash out"

via an input device of the gaming system. In such an embodiment, the gaming system may dispense a value to the player, through a value dispenser, based on the player's gaming credit balance as illustrated in block 390 and operation 300 ends.

On the other hand, if the gaming system processor has not received a signal to end game play (or to "cash out") via the player input device, the process of operation 300 returns to block 315 via off page connector B. The gaming system may receive, via a player input device, a wager for another play of the game and continue operation 300 from block 315. However, in one embodiment, the wager may not be accepted if the player has fewer credits than the player's selected wager amount as shown in block 315.

As can be appreciated, a gaming system having a plurality of independent symbol sets that are interleaved, but can be evaluated separately and together to create new ways to win awards, can provide new opportunities for symbol interactions between symbols of the respective independent symbol sets. In some embodiments where a symbol displayed on the first set of reels is associated with a different symbol displayed on the second set of reels, when the gaming system generates the two different symbols on adjacent reels and in adjacent symbol display areas, the gaming system may issue an additional award or an award enhancement. For example, if a Fish symbol from the first set of reels is displayed adjacent (adjacent reel and adjacent symbol display area) to a Fishing Pole symbol from the second set of reels, the gaming system may evaluate to determine a predetermined interaction with the two different symbols. In one embodiment, the gaming system may determine that the Fishing Pole symbol should be cast to the symbol display area with the Fish symbol and the Fish symbol will bite a piece of bait on the a hook of the Fishing Pole symbol. The gaming system may also evaluate (e.g., based on a pay table) an award for the interaction between the Fish symbol and the Fishing Pole symbol. In one embodiment, the award for the interaction can be a predetermined or randomly generated credit award. In one embodiment, the award for the interaction can be a predetermined or randomly generated award enhancement such as a credit multiplier. The gaming system may use the credit multiplier with any award or awards determined in blocks 350, 365, and 370. In one embodiment, the award for the interaction can be a non-monetary award, such as a symbol modifier. For example, the caught Fish symbol may cause the symbols above or below the Fish symbol (or all of the other symbols on the same reel as the Fish symbol) to be converted into a different predetermined symbol. The predetermined symbol may be the same Fish symbol or some other suitable symbol. In some embodiments, the gaming system may convert certain other symbols on other reels to Fish symbols too. The gaming system may then perform a reevaluation of the reels sets (e.g., each set individually or with the sets together) for winning symbol combinations. The gaming system may provide updated awards (or additional awards) based on the reevaluation of the displayed symbols. In some embodiments, the altered symbols can cause a chain reaction and the gaming system may convert other symbols on other reels based on the initially converted symbols. That is, after the initial symbols are converted into Fish symbols, the gaming system may revaluate the displayed symbols to determine if the new Fish symbols should interact with other displayed symbols (e.g., other adjacent and displayed Fishing Pole symbols) to create additional awards or award enhancements. In some embodiments, the interaction between associated symbols must occur along active pay lines. Thus, in some embodiments, if the player has not wagered on a pay line where two symbols would have interacted to generate an additional award or enhanced award, the gaming system may not provide the player such an additional award or enhanced award.

In some embodiments, due to the different independent evaluations of the first and second sets of reels and the combined evaluation of the both the first and second sets of reels, the gaming system may be configured to treat one or more symbols differently in the same game. For example, the gaming system may evaluate a Fish symbol as a pay symbol or a scatter symbol when the gaming system evaluates the Fish symbol as part of the independent evaluation of symbols displayed on the first set of reels. However, the gaming system may evaluate the same Fish symbol differently during the combination evaluation of the symbols of the first and second set of reels. For example, the gaming system may cause the Fish symbol to be a multiplier when the Fish symbol is on a pay line of winning symbol combinations during the combination evaluation of the symbols of the first and second set of reels. As another example, the gaming system may cause the Fish symbol to be evaluated as a Wild symbol during the combination evaluation of the symbols of the first and second set of reels. It should be appreciated that the gaming system can apply other suitable features to such a symbol.

Based on the above description, it should be appreciated that playing with a second independent set of reels enables a gaming system to provide numerous new and different ways to generate awards for players. Because the gaming system can evaluate the first set of reels and the second set of reels independently and together to determine game awards, the gaming system can be viewed as providing three or more different games as part of one play of the game. Thus, a player's one wager in some embodiments may enable the player to obtain awards associated with three different games.

FIGS. 4A-4G illustrate screenshots of one embodiment of a gaming system having independent symbol sets that are interleaved, but can be evaluated separately and together.

Figure 4A:
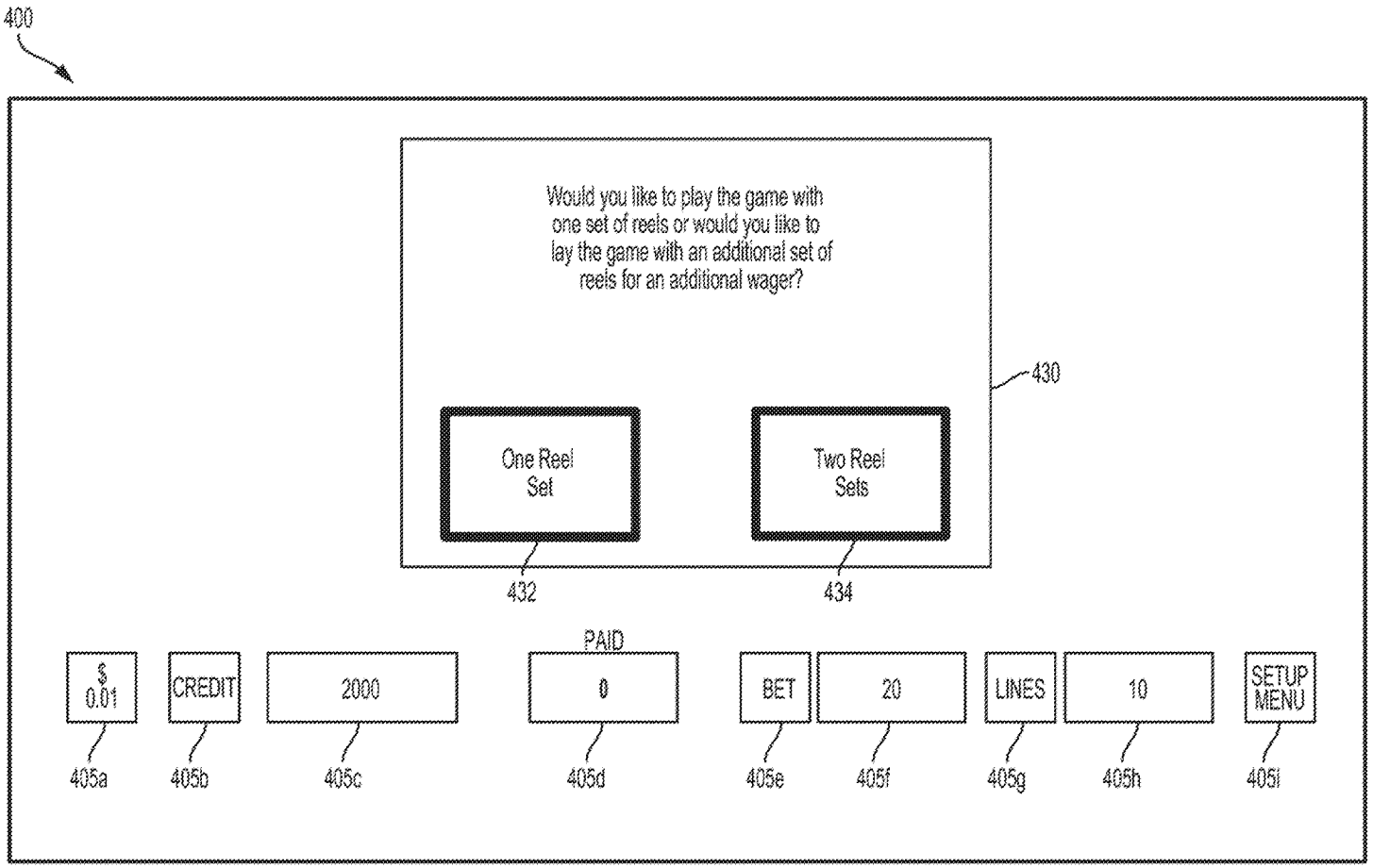
FIGS. 4A, 4B, 4C, 4D, 4E, 4F, and 4G illustrate screen shots of one embodiment of a gaming system having independent symbol sets that are interleaved, but can be evaluated separately and together.

FIG. 4A illustrates one embodiment of a game display 400 that the gaming device 100 may display on a display device of the gaming system. In one embodiment, game display 400 may be displayed on first display 120 of gaming device 100 illustrated in FIG. 1. However, any other suitable display may be used. Game display 400 includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 200 credits (i.e., the player has selected to wager 20 credits (405*f*) on each of 10 pay lines (405*h*) for a total wager of 200 credits). Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*.

To initiate a play of the game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time. In some embodiments, the gaming system may ask the player in a game selection area 430 "Would you like to play the game with one set of reels or would you like to play the game with an additional set of reels for an additional wager." The player has the option of pressing the One Reel Set button 432 on the software touch screen to play the game with one set of reels game or pressing the Two Reel Sets button 434 on the software touch screen to play the additional reel set game. As noted above, it should be appreciated that selection of the game to play is not limited to pressing a software touch screen button. Rather, software touch screen buttons can be replicated or replaced with a hardware button on the gaming device 100. Therefore, a software touch screen button and a hardware button are both considered to be a player input device. As also noted above, it should be appreciated that in some embodiments the gaming system does not present such options to the player. In some embodiments, any suitable minimum wager enables the player to automatically obtain both sets of reels for a play of the game. However, in some embodiments, a predetermined wager threshold is required before the gaming system provides both sets of reels to the player. In some embodiments, the gaming system requires another higher predetermined wager threshold before the gaming system evaluates a combination of symbols from both sets of reels.

In one embodiment, the gaming system may update the player's credit meter (information area 405*c*) to reflect the player's available credit balance after the wager. Should the player select to play the game with one set of reels, by pressing the One Reel Set button 432, the player's credit meter (information area 405*c*) was decremented by 200 credits to reflect the 200 credit wager the player placed for the play of the game. Should the player select to play the game with both sets of reels, by pressing the Two Reel Sets button 434, the player's credit meter (information area 405*c*) was decremented by 400 credits from 2400 to 2000 to reflect the 200 credit wager the player placed for the play of the game with one reel set and the additional 200 credit wager the player placed to play the game with the second reel set. For the sake of brevity, only the deducted credits in the player's credit meter (information area 405*c*) is shown in FIG. 4A. It should be appreciated that the manner for which the player selects the game to play and the appropriate credits deducted to play the additional reel set game are only for illustrative purposes.

Figure 4B:
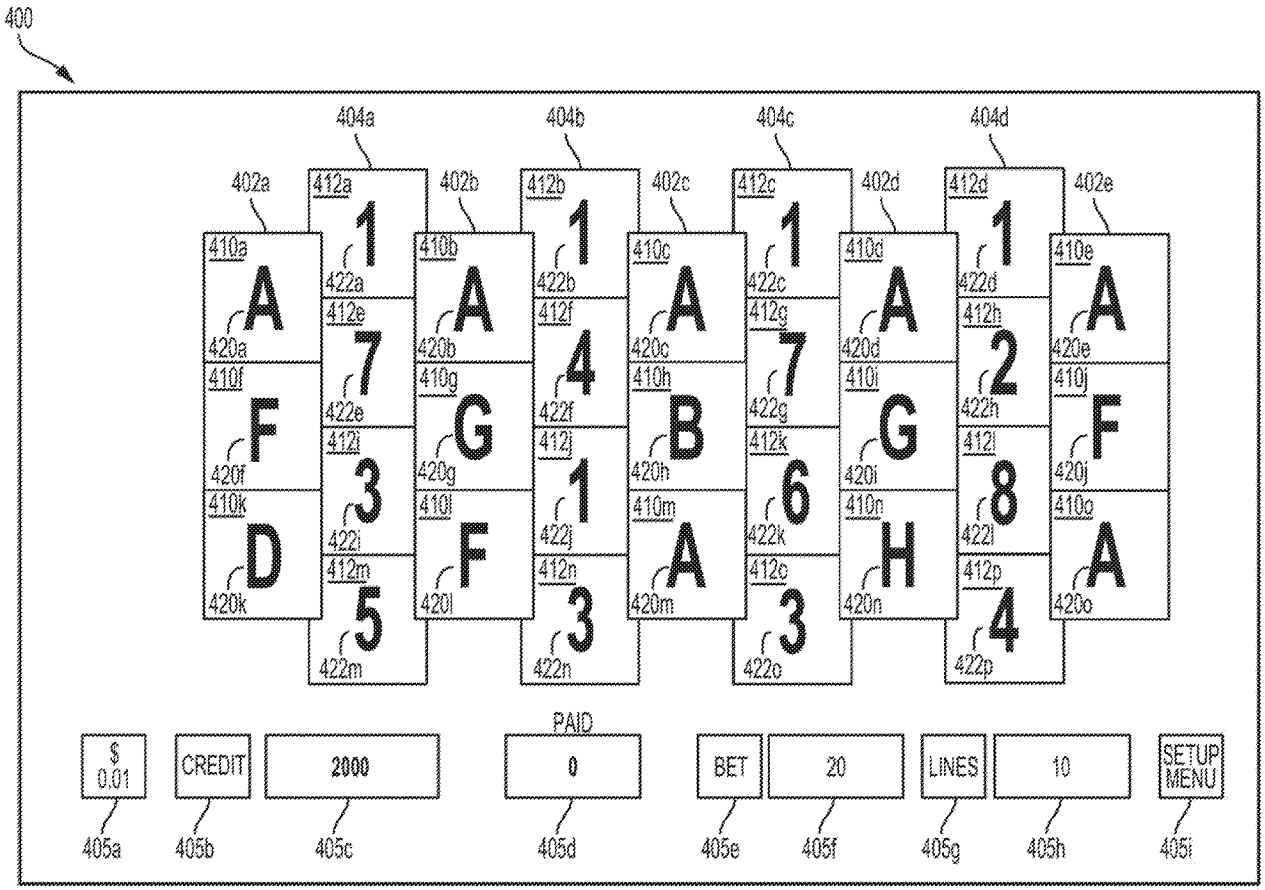

As illustrated in FIG. 4B, the game display 400 displays a first set of reels 402*a*, 402*b*, 402*c*, 402*d*, and 402*e* (e.g., the first set of reels). The game 400 also displays a second set of reels 404*a*, 404*b*, 404*c*, 404*d* as illustrated in FIG. 4B. As further illustrated in FIG. 4B, the first set of reels 402*a*-402*e* and the second set of reels 404*a*-404*d* are displayed on the game display 400 such that the reels alternate between a reel of the first set of reels 402*a*-402*e* and a reel of the second set of reels 404*a*-404*d*. In particular, FIG. 4B illustrates reel 402*a* of the first set of reels as the first reel, reel 404*a* of the second set of reels as the second reel adjacent to the first reel 402*a*; reel 402*b* of the first set of reels as the third reel adjacent to the second reel 404*a*; reel 404*b* of the second set of reels as the fourth reel adjacent to the third reel 402*b*, and so on. Each of the reels 402*a*, 402*b*, 402*c*, 402*d*, or 402*e* of the first set of reels is spaced from another reel of the first set of reels. A portion of one of the reels 404*a*, 404*b*, 404*c*, or 404*d* of the second set of reels is displayed between two reels of the first set of reels to create the display of the reels alternating between a reel of the first set of reels and a reel of the second set of reels. A portion of each of the reels 404*a*-404*d* of the second set of reels is displayed between two reels of the first set of reels 402*a*-402*e* such that the second set of reels is located behind the first set of reels in some embodiments. In different embodiments, the gaming system may generate the reels 402*a*-402*e* as covering more of 404*a*-404*d*. In some embodiments, the gaming system may show very little of the second set of reels 404*a*-404*d*. In some embodiments, the gaming system generates the reels 402*a*-402*e* to be more prominent than the second set of reels 404*a*-404*d* to let the player know that the generated first plurality of symbols on the first set of reels 402*a*-402*e* will be evaluated first for winning combinations. It should be appreciated that the gaming system may evaluate the sets of reels in any suitable order in different embodiments. It should also be appreciated that the game shown in game display 400 is merely representative and may have more or fewer game elements (e.g., reels, symbol display areas, symbols, etc.) shown in the game display 400.

The first set of reels 402*a*-402*e* are each associated with their own symbol set based on a first symbol set, where the first symbol set includes a plurality of symbols. The first symbol set may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the first symbol set may include pay symbols and special or designated symbols.

The second set of reels 404*a*-404*d* are each associated with their own symbol set based on a second symbol set, where the second symbol set includes a plurality of symbols. The second symbol set may include numbers, letters, geometric figures, symbols, images, character, blank symbols, animations, transparent symbols (e.g., symbols that permits underlying symbols to be visible), or any other suitable graphical depiction. The symbols in the second symbol set may include pay symbols and special or designated symbols.

In some embodiments, the first symbol set may include symbols that are different from the second symbol set. In some embodiments, all of the symbols from the first symbol set are different from all of the symbols in the second symbol set. In the illustrated FIG. 4B-4G, the first symbol set is associated with the first set of reels 402*a-e* and includes alphabet letters. The alphabet letter from the first symbol set are not included in the second symbol set associated with the second set of reels 404*a-d*. The second symbol set associated with the second set of reels 404*a-d* in FIG. 4B include numbers which are not symbols included in the first symbol set associated with the first set of reels 402*a-e*.

Returning now to FIG. 4B, the game display 400 depicts a first set of symbol display areas (also referred to herein as symbol display positions) 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. These plurality of symbol display areas can be associated in a manner that provides the appearance of game reels. It should also be appreciated that the symbol display areas may not be associated with game reels in some embodiments. As illustrated in FIG. 4B, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five slot machine game reels. In one embodiment, the first set of symbol display areas that provide the appearance of five game reels may be arranged in a manner that visibly shows three symbol positions of each of the five game reels of the first set of reels. For example, the first set of symbol display areas 410*a*-410*o* are each associated with positions on the first set of reels 402*a*-402*e*, respectively. As shown in FIG. 4B, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the embodiment of FIG. 4B thus creates a visible display area of the reels 402*a*-402*e* comprising three visible symbol positions for each reel. When viewed together and separate from the second set of reels, the first set of reels 402*a*-402*e* appear like a 3-row by 5-column reel array in display 400. In other embodiments, smaller or larger visible areas of the reels can be displayed. That is, the first set of reels 402*a*-402*e* may show fewer or a larger number of visible symbol display areas. While symbol display areas are illustrated with defined boxes, it should be appreciated that in some embodiments, the defined boxes are not visible to the player. It should also be appreciated that in some embodiments, the symbol display areas are other shapes or not defined shapes and may not be associated with reels.

Each reel of the first set of reels 402*a*-402*e* may display a plurality of symbols that the gaming system generates from their respective symbol sets (based on the first symbol set) in their respective symbol display areas as illustrated in FIG. 4B. In one embodiment, the first set of reels 402*a*-402*e* may be shown spinning in one direction to simulate slot machine reels. However, it should be appreciated that the reels may be shown spinning in any suitable direction. The reels may also be shown spinning in different directions in some embodiments.

The game display 400 of FIG. 4B further depicts a second set of symbol display areas (also referred to herein as symbol display positions) 412*a*, 412*b*, 412*c*, 412*d*, 412*e*, 412*f*, 412*g*, 412*h*, 412*i*, 412*j*, 412*k*, 412*l*, 412*m*, 412*n*, 412*o*, and 412*p*. These plurality of symbol display areas can be associated in a manner that provides the appearance of game reels. It should also be appreciated that the symbol display areas may not be associated with game reels in some embodiments. As illustrated in FIG. 4B, symbol display areas 412*a*, 412*b*, 412*c*, 412*d*, 412*e*, 412*f*, 412*g*, 412*h*, 412*i*, 412*j*, 412*k*, 412*l*, 412*m*, 412*n*, 412*o*, and 412*p* are associated in a manner that provides the appearance of a set of four slot machine game reels. In one embodiment, the second set of symbol display areas that provide the appearance of four game reels may be arranged in a manner that visibly shows four symbol positions of each of the four game reels of the second set of reels. For example, the second set of symbol display areas 412*a*-412*p* are each associated with positions on the second set of reels 404*a*-404*d*, respectively. As shown in FIG. 4B, symbol display areas 412*a*, 412*e*, 412*i* and 412*m* are associated with reel 404*a*; symbol display areas 412*b*, 412*f*, 412*j* and 412*n* are associated with reel 404*b*; symbol display areas 412*c*, 412*g*, 412*k* and 410*o* are associated with reel 404*c*; and symbol display areas 412*d*, 412*h*, 412*l* and 412*p* are associated with reel 404*d*. The arrangement illustrated in the embodiment of FIG. 4B thus creates a visible display area of the second set of reels 404*a*-404*d* comprising four visible symbol positions for each reel. When viewed together and separate from the first set of reels, the second set of reels 404*a*-404*d* appear like a 4-row by 4-column reel array in display 400. In other embodiments, smaller or larger visible areas of the reels can be displayed. That is, the second set of reels 404*a*-404*d* may show fewer or a larger number of visible symbol display areas. While symbol display areas are illustrated with defined boxes, it should be appreciated that in some embodiments, the defined boxes are not visible to the player. It should also be appreciated that in some embodiments, the symbol display areas are other shapes or not defined shapes and may not be associated with reels.

Each reel of the second set of reels 404*a*-404*d* may display a plurality of symbols that the gaming system generates from their respective reels (based on the second symbol set) in their respective symbol display areas as illustrated in FIG. 4B. In one embodiment, the second set of reels 404*a*-404*d* may be shown spinning in one direction to simulate slot machine reels. However, it should be appreciated that the reels may be shown spinning in any suitable direction. The reels may also be shown spinning in different directions in some embodiments.

It should be appreciated that the gaming system may generate the symbols for the first set of reels 402*a*-402*e* and the second set of reels 404*a*-404*d* at substantially the same time in some embodiments. In other embodiments, the gaming system may generate the symbols for the first set of reels 402*a*-402*e* and the second set of reels 404*a*-404*d* at different times. The gaming system may likewise display the generated symbols for the first set of reels 402*a*-402*e* and the second set of reels 404*a*-404*d* at substantially the same time or at different times in different embodiments.

Upon receipt of the player's wager, selection of type of game to play, and activation of the game start button, the gaming system may show a display of spinning reels for each of the first set of reels 402*a*-402*e* and a display of spinning reels for each of the second set of reels 404*a*-404*d*. The spinning may appear to occur in a vertical top to bottom direction or in a vertical bottom to top direction (not shown), or in a combination of vertical directions (not shown). In one embodiment, the gaming system randomly generates a first plurality of symbols for the first set of reels 402*a*-402*e* and randomly generates a second plurality of symbols for the second set of reels 404*a*-404*d*. As noted above, the gaming system may rely on random generation performed by a pseudo RNG, a true RNG, or hardware RNG specifically designed for gaming systems.

The gaming system displays the generated first set of symbols 420*a*-420*o* in first symbol display areas 410*a*-410*o* as illustrated in FIG. 4B. Symbols 420*a*-420*o* displayed on the first set of reels 402*a*-402*e* illustrate the randomly generated symbols from the first symbol set after the reels have stopped spinning. As illustrated in FIG. 4B, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*.

As illustrated in FIG. 4B, the gaming system generated and displayed letter A symbols (420*a*, 420*b*, 420*c*, 420*d*, 420*e*, 420*m*, 420*o*), a letter B symbol (420*h*), a letter D symbol (420*k*), letter F symbols (420*f*, 420*j*, 420*l*), letter G symbols (420*g*, 420*i*), and a letter H symbol (420*n*) on the first set of reels 402*a*-402*e* in the game display 400. It should be appreciated that the displayed symbol combinations are merely for explanatory purposes and the gaming system may randomly generate any suitable combination of symbols based on defined symbol sets associated with the first set of reels 402*a*-402*e*.

The gaming system further displays the generated second set of symbols 422*a*-422*p* in second symbol display areas 412*a*-412*p* as illustrated in FIG. 4B. Symbols 422*a*-422*p* displayed on the second set of reels 404*a*-404*d* illustrate the randomly generated symbols from the second symbol set after the reels have stopped spinning. As illustrated in FIG. 4B, the gaming system randomly generated and displayed symbols 422*a*, 422*e*, 422*i*, and 422*m* in symbol display areas 412*a*, 412*e*, 412*i*, and 412*m* for reel 404*a*. The gaming system also randomly generated and displayed symbols 422*b*, 422*f*, 422*j*, and 422*n* in symbol display areas 412*b*, 412*f*, 412*j* and 412*n* for reel 404*b*; symbols 422*c*, 422*g*, 422*k*, and 422*o* in symbol display areas 412*c*, 412*g*, 422*k*, and 412*o* for reel 404*c*; symbols 422*d*, 422*h*, 422*l*, and 422*p* in symbol display area 412*d*, 412*h*, 412*l*, and 412*p* for reel 404*d*.

As illustrated in FIG. 4B, the gaming system generated and displayed number 1 symbols (422*a*, 422*b*, 422*c*, 422*d*, 422*j*), a number 2 symbol (422*h*), number 3 symbols (422*i*, 422*n*, 422*o*), number 4 symbols (422*f*, 422*p*), a number 5 symbol (422*m*), a number 6 symbol (422*k*), number 7 symbols (422*e*, 422*g*), and a number 8 symbol (422*l*) on the second set of reels 404*a*-404*d* in the game display 400. It should be appreciated that the displayed symbol combinations are merely for explanatory purposes and the gaming system may randomly generate any suitable combination of symbols based on defined symbol sets associated with the first set of reels 404*a*-404*d*.

Figure 4C:
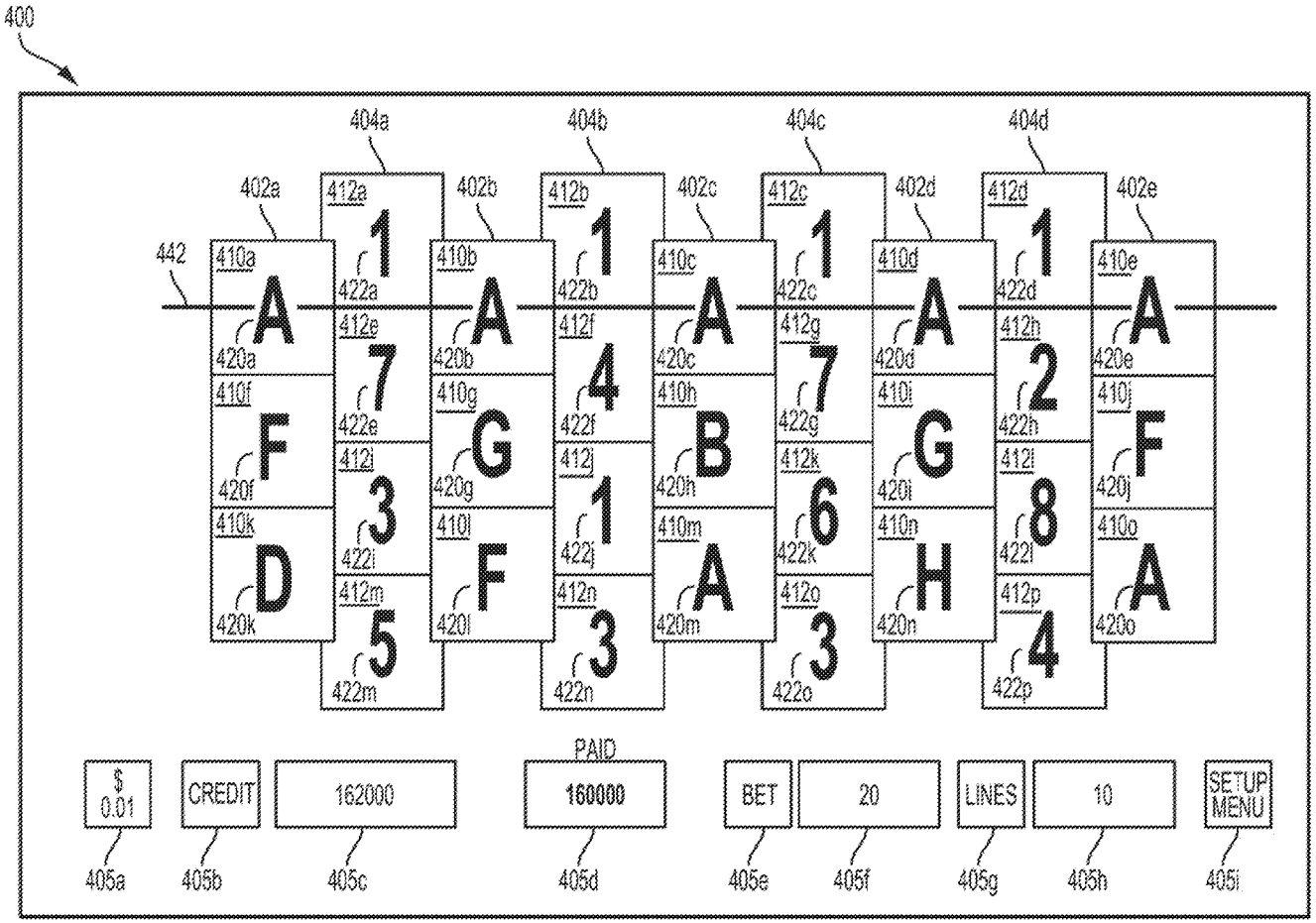
Figure 4D:
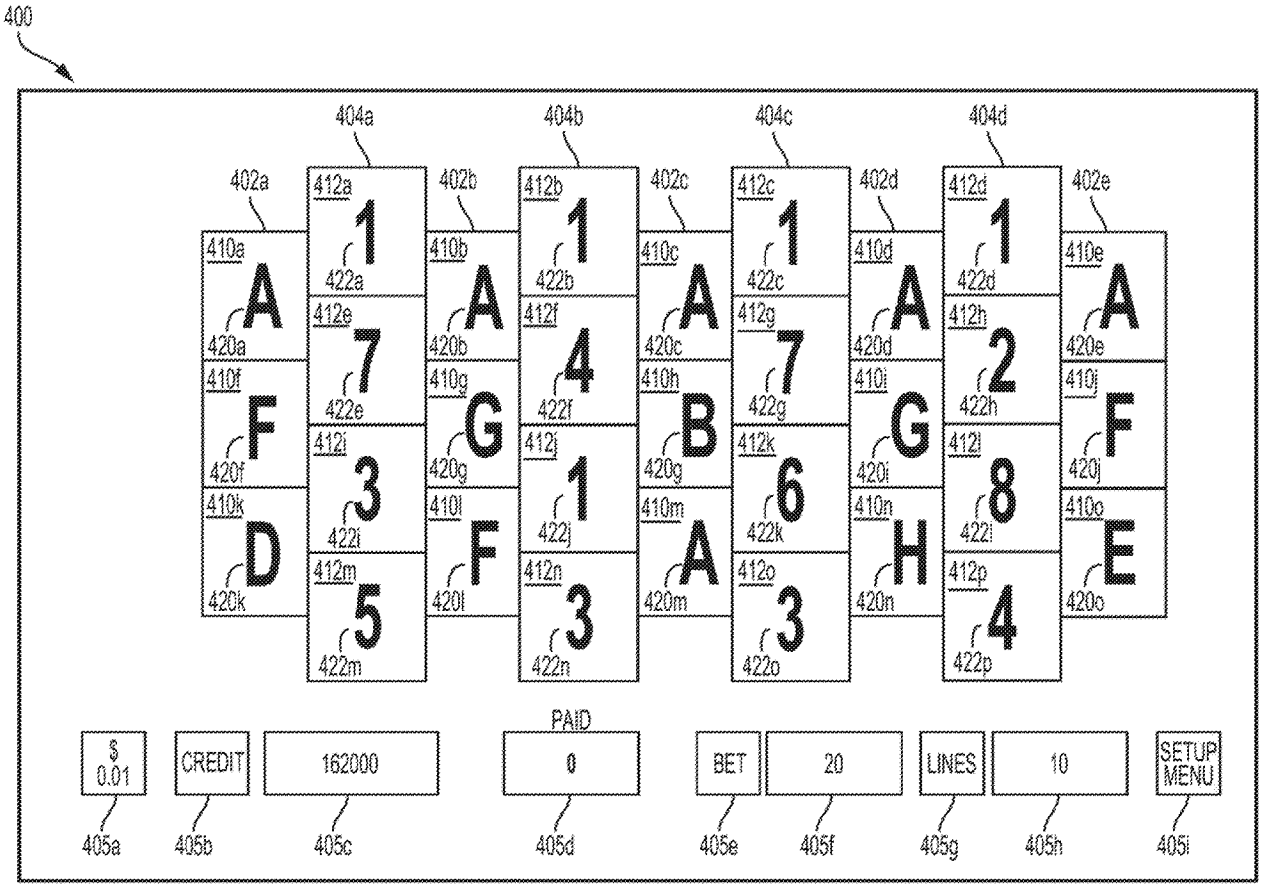

FIG. 4C illustrates one embodiment of a gaming system executing an evaluation of the generated first set of symbols 420*a*-420*o* on the first set of reels 402*a*-402*e* for winning symbol combinations. As noted above, the player may have wagered on one or more pay lines (such as 10 pay lines shown in information area 405*h*). In one embodiment, at least the active (wagered on pay lines) are evaluated for winning symbol combinations. Any suitable number of pay lines may be used to evaluate winning symbol combinations.

In the embodiment illustrated in FIG. 4C, the gaming system determined that a winning symbol combination is displayed across one wagered pay line. The pay line spans across a horizontal direction of symbol display areas including symbol display areas 410*a*, 410*b*, 410*c*, 410*d*, and 410*e*. In this embodiment, the gaming system displayed five letter A symbols along a horizontal pay line on which the player had placed a wager. The gaming system determined the five letter A symbols form a winning symbol combination based on a pay table associated with the gaming system (such as the First Reel Set Pay Table in FIG. 5A). The winning pay line is illustrated as pay line 442 in FIG. 4C across the row of reels 402*a*-402*e*.

It should be noted that since the reels alternate between a reel of the first set of reels 402*a*-402*e* and a reel of the second set of reels 404*a*-404*d*, the winning symbol combinations for the first set of reels are not formed across adjacent reels; rather, the winning symbol combinations can be formed across every other reel.

In one embodiment, the gaming system may award the appropriate number of credits to the player and update the player's win meter (shown in information area 405*d*) to reflect the player's winnings based on winning symbol combinations across wagered pay lines of the first set of reels. The gaming system may also update the player's credit meter (information area 405*c*) to reflect the player's available credit balance. In the embodiment illustrated in FIG. 4C, the player's win meter (information area 405*d*) was updated to 160000 to reflect the payout amount based on the First Reel Pay Table in FIG. 5A and credit meter (information area 405*c*) was increased by 160000 credits from 2000 to 162000 to reflect the 160000 credits payout award. In an alternative embodiment, the gaming system may wait to provide the appropriate number of credit award to the player, update the player's win meter (information area 405*d*), and update the player's credit meter (information area 405*c*) until after all award amounts have been determined.

In some embodiments, the gaming system determines, with the processor of the gaming system, whether the player selected to play the game with one reel set (e.g., pressed the One Reel Set button 432) or selected to play the game with the additional reel set (e.g., pressed the Two Reel Set button 434). In some embodiments, if the player selected to play only the game with one reel set, no further determination of payout amount based on winning symbol combinations across wagered pay lines games remains. Therefore, the play of the game ends. The player may continue to play additional games or cash out as discussed in connection with FIGS. 3A-3C. In some embodiments, the gaming system may perform the evaluation of the second set of reels even if the player did not elect to play the game with the second set of reels. The gaming system may show the additional evaluations and the awards the player would have won if the player played the game with the extra set of reels. The gaming system may show the generated second set of symbols 422*a*-422*p* of the second set of reels 404*a*-404*d* displayed in the background. Showing the player what could have been won may increase player's interest in playing the additional reel set game in the future.

If the gaming system determines that the game is played with the second set of reels, in one embodiment the gaming system evaluates the generated second set of symbols 422*a*-422*p* on the second set of reels 404*a*-404*d* for winning symbol combinations. In the embodiment illustrated in FIG. 4D, a portion of at least one of the reels 402*a*, 402*b*, 402*c*, 402*d*, and 402*e* of the first set of reels is displayed partially covered by some of the second set of reels 404*a*-404*d*. The amount that the first set of reels is covered by the second set of reels can vary. In some embodiments, a portion of each of the reels 402*a*-402*e* are hidden to help the player understand that the generated second set of symbols 422*a*-422*p* on the second set of reels 404*a*-404*d* will be evaluated for winning symbol combinations. It should be appreciated that the game shown in game display 400 is merely representative and may have more or fewer game elements (e.g., reels, symbol display areas, symbols, etc.) shown in the game display 400.

Figure 4E:
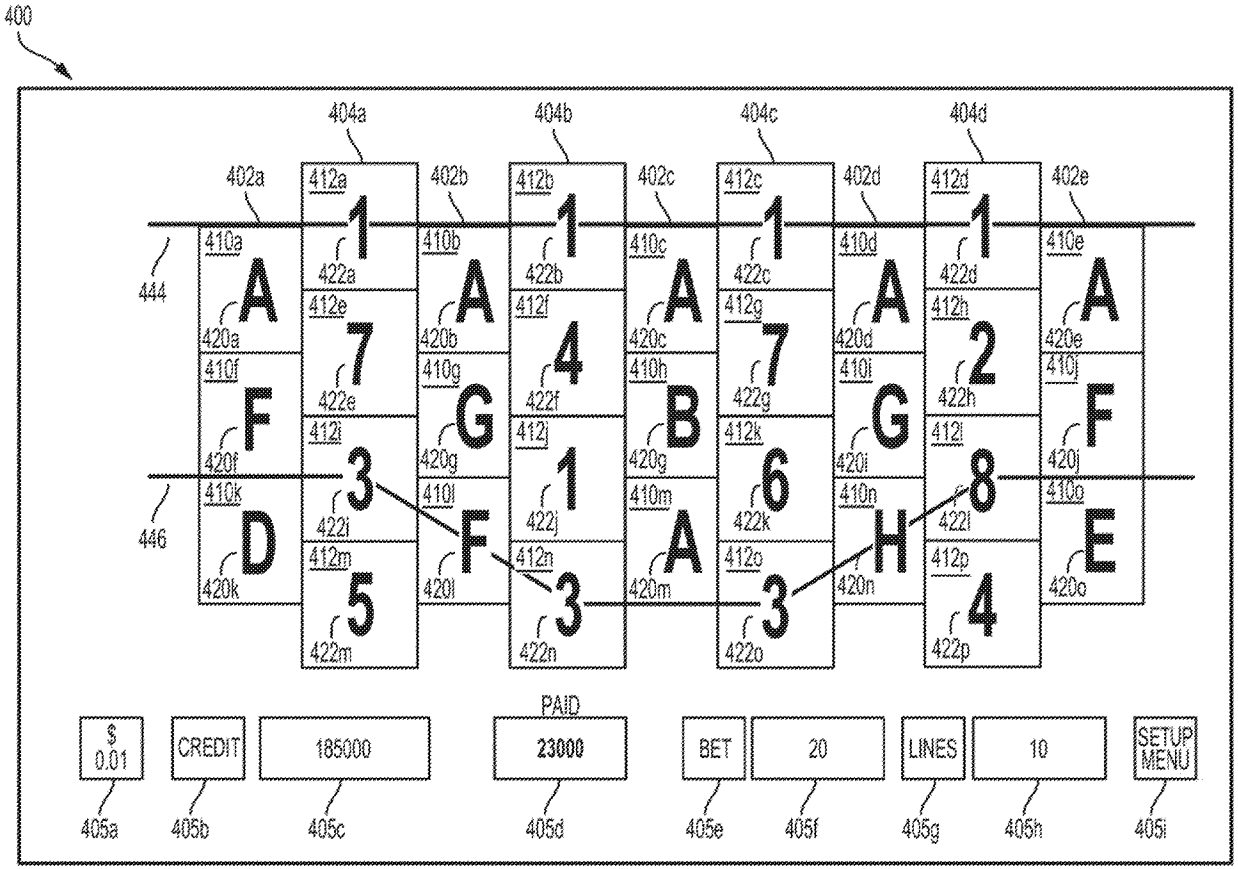

In the embodiment illustrated in FIG. 4E, the gaming system determined that winning symbol combinations are displayed across two wagered pay lines. One pay line spans across a horizontal direction of symbol display areas including symbol display areas 412*a*, 412*b*, 412*c*, and 412*d* of the second set of reels. In this embodiment, the gaming system displayed four number 1 symbols along a horizontal pay line on which the player had placed a wager. The gaming system determined the four number 1 symbols form a winning symbol combination based on a pay table associated with the gaming system (such as the Second Reel Set Pay Table in FIG. 5B). This winning pay line is illustrated as pay line 444 in FIG. 4E across the row of reels 404*a*-404*d*. A second pay line spans across a non-linear direction of symbol display areas including symbol display areas 412*i*, 412*n*, 412*o*, and 412*l*. In this embodiment, the gaming system displayed three number 3 symbols along a non-linear pay line on which the player had placed a wager. The gaming system determined the three number 3 symbols formed a winning combination based on a pay table associated with the gaming system. This winning pay line is illustrated as pay line 446 in FIG. 4E across the row of reels 404*a*-404*d*.

It should be noted that since the reels alternate between a reel of the first set of reels 402*a*-402*e* and a reel of the second set of reels 404*a*-404*d*, the winning symbol combinations for the second set of reels are not formed across adjacent reels; rather, the winning symbol combination are formed across every other reel. It should also be appreciated that the first set of symbols and the second set of symbols can be evaluated based on different pay tables.

In one embodiment, the gaming system may award the appropriate number of credits to the player and update the player's win meter (shown in information area 405*d*) to reflect the player's winnings based on winning combinations across wagered pay lines of the second set of reels. The gaming system may also update the player's credit meter (information area 405*c*) to reflect the player's available credit balance. In the embodiment illustrated in FIG. 4E, the player's win meter (information area 405*d*) was updated to 23000 to reflect the total payout amount based on the Second Reel Pay Table in FIG. 5A and credit meter (information area 405*c*) was increased by 23000 credits from 162000 to 185000 to reflect the 23000 credits payout award. In an alternative embodiment, the gaming system may wait to provide the appropriate number of credit award to the player, update the player's win meter (information area 405*d*), and update the player's credit meter (information area 405*c*) until after all payout amounts have been determined.

It should be appreciated that the gaming system may deemphasize certain reels (e.g., by hiding a portion or all of the reels) when the gaming system is attempting to emphasize certain other reels. This enables the gaming system to provide additional clarity to player to determine how certain winning symbol combinations are formed with the two independent sets of reels.

Figure 4F:
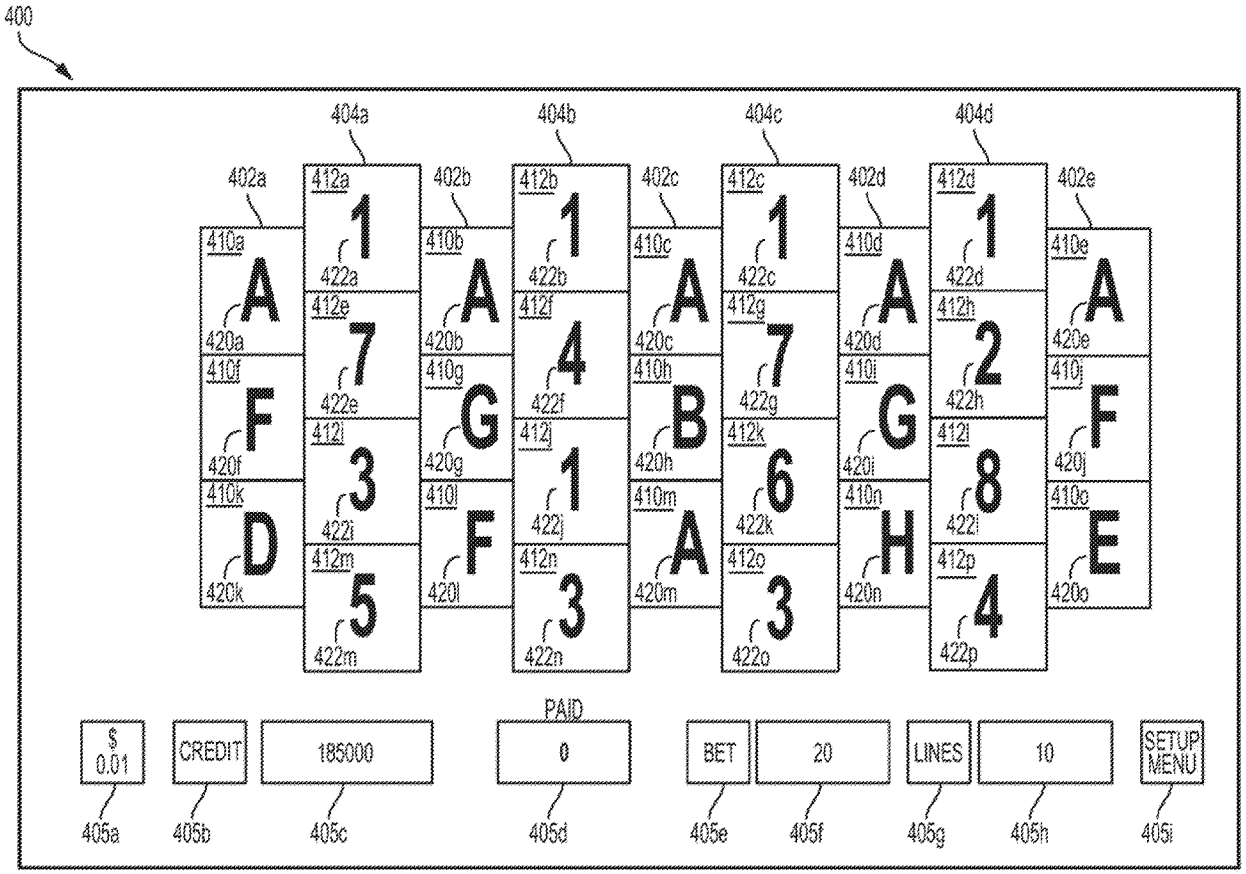

In one embodiment illustrated in FIG. 4F, the reels 404*a*, 404*b*, 404*c*, or 404*d* of the second set of reels are displayed between reels of the first set of reels to create the display of the reels alternating between a reel of the first set of reels and a reel of the second set of reels. In some embodiments, the entire width of each of the reels of the first set of reels 402*a*-402*e* and the entire width of each of the reels of the second set reels 404*a*-404*d* are displayed to let the player know that the combination of both the generated first plurality of symbols 420*a*-420*o* of the first set of reels 402*a*-402*e* and the generated second plurality of symbols 422*a*-422*p* of the second set of reels 404*a*-404*d* will be evaluated together for winning symbol combinations (e.g., as if the two sets of reels are treated as a single set of reels for this portion of the game). It should be appreciated that the game shown in game display 400 is merely representative and may have more or fewer game elements shown in the game display 400.

Figure 4G:
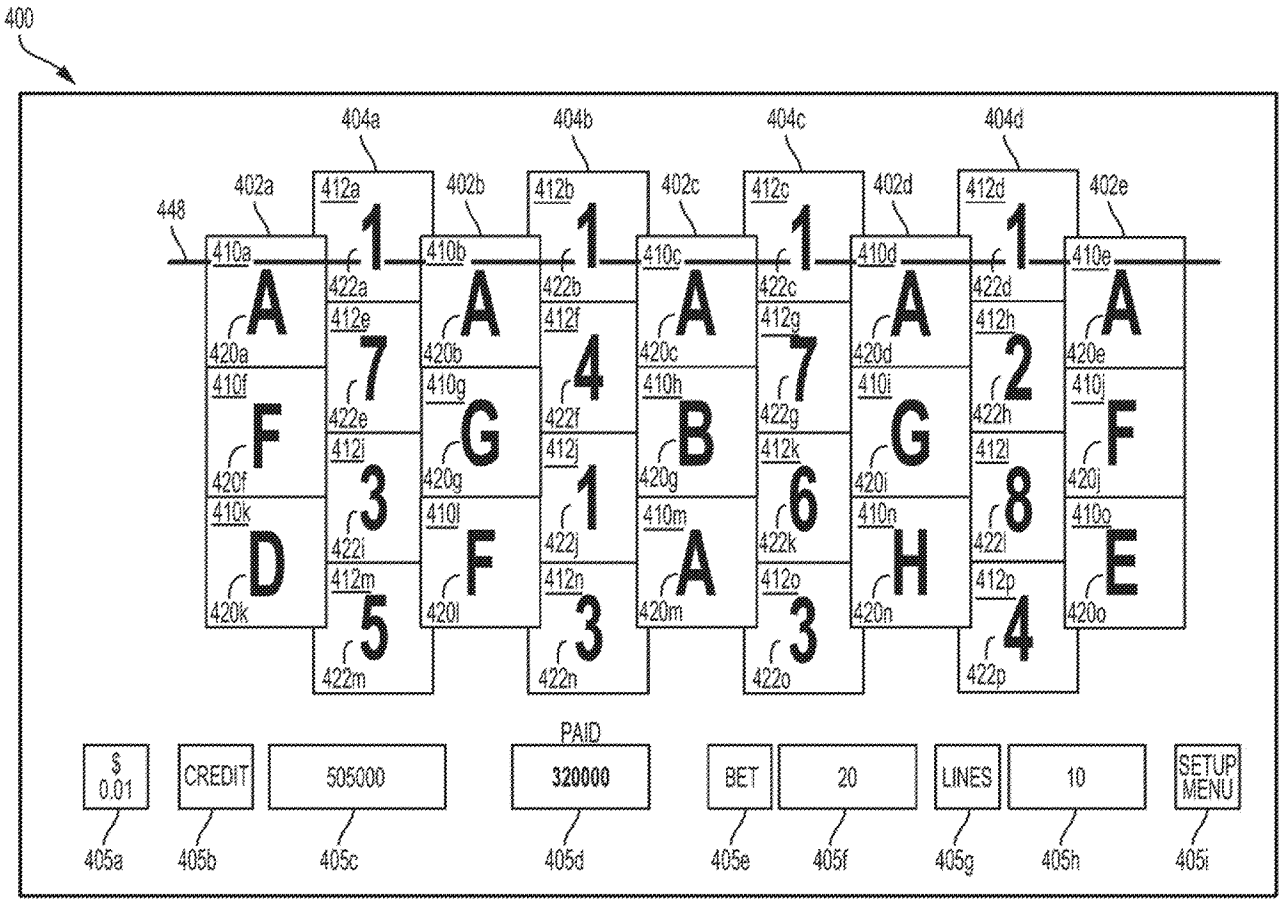

In FIG. 4G, the gaming system determined that winning symbol combinations are displayed across a wagered pay line. The pay line spans across a horizontal direction of symbol display areas including symbol display areas 410*a*, 412*a*, 410*b*, 412*b*, 410*c*, 412*c*, 410*d*, 412*d*, and 410*e*. In this embodiment, the gaming system displayed only letter A and number 1 symbols (e.g., five A's interleaved with four 1's or A1A1A1A1A) along a horizontal pay line on which the player had placed a wager. The gaming system determined the alternating nine letter A and number 1 symbols form a winning symbol combination based on a pay table associated with the gaming system for this third evaluation (such as the Reel Sets Combined Pay Table in FIG. 5C). The winning pay line is illustrated as pay line 448 in FIG. 4G across the row of reels 402*a*, 404*a*, 402*b*, 404*b*, 402*c*, 404*c*, 402*d*, 404*d*, and 402*e*.

It should be noted that even though the reels alternate between a reel of the first set of reels 402*a*-402*e* and a reel of the second set of reels 404*a*-404*d*, since the winning symbol combination for this section of the game includes the combination of the first set of reels and the second set of reels, the winning symbol combination are formed across adjacent reels.

In one embodiment, the gaming system may award the appropriate number of credits to the player and update the player's win meter (shown in information area 405*d*) to reflect the player's winnings based on winning symbol combinations across wagered pay lines of the combined first and second sets of reels. The gaming system may also update the player's credit meter (information area 405*c*) to reflect the player's available credit balance. In the embodiment illustrated in FIG. 4G, the player's win meter (information area 405*d*) was updated to 320000 to reflect the award amount based on the Reel Sets Combined Pay Table in FIG. 5C and credit meter (information area 405*c*) was increased by 320000 credits from 185000 to 505000 to reflect the 320000 credit payout award. In an alternative embodiment, the gaming system may wait to provide the appropriate number of credits to the player, update the player's win meter (information area 405*d*), and update the player's credit meter (information area 405*c*) until after all payout amounts have been determined.

In the illustrated embodiment, no further determination of award amounts based on winning symbol combinations across wagered pay lines games remain. Therefore, the play of the game ends. The player may continue to play additional games or cash out as discussed in connection with FIGS. 3A-3C.

It should be appreciated, as was discussed in connection with FIG. 3A-3C, in some embodiments, certain different symbols can be associated to create award enhancements. For example, the A symbol and the 1 symbol can be associated such that when the gaming system generates these symbols in adjacent symbol display areas of adjacent reels, the gaming system may provide additional awards or award enhancements. These symbols may also be evaluated differently depending on whether the gaming system is evaluating the reel sets individually or evaluating the reel sets together. For example, in one embodiment, if the A and 1 symbol are generated in adjacent symbol display areas on adjacent reels, the gaming system may cause the A symbol to "kick up" or "kick down" and convert the symbols in at least one of the reels of the first set of reels to A symbols. The gaming system may then perform the above discussed evaluations again to determine if the converted symbols provides additional awards or any award enhancements.

It should also be noted that the unique alternation of reels between different reel sets creates many unique new win possibilities (e.g., new combinations of symbols) that were not previously available. As shown in the embodiments of FIG. 4B-4G, each reel of the second set of reels includes more symbols than each reel of the first set of reels. In one embodiment (as illustrated in FIG. 4B-4G), the second set of reels 404*a*-404*d* are oriented in a manner such that two of each of the symbol display areas of each of reels 404*a*-404*d* straddle at least one of the symbol display areas of the first set of reels. One example benefit can be seen if the gaming system also generated 1 symbols in the symbol display areas 412*e*, 412*f*, 412*g*, and 412*e*. In such an embodiment, the gaming system can provide multiple simultaneous substantially horizontal pay line using the same symbols from the first set of reels. It should be appreciated that with the alternating 3 row reel and 4 row reel, the gaming system can be configured with 62, 208 different potential symbol combination variations.

Figure 5A:
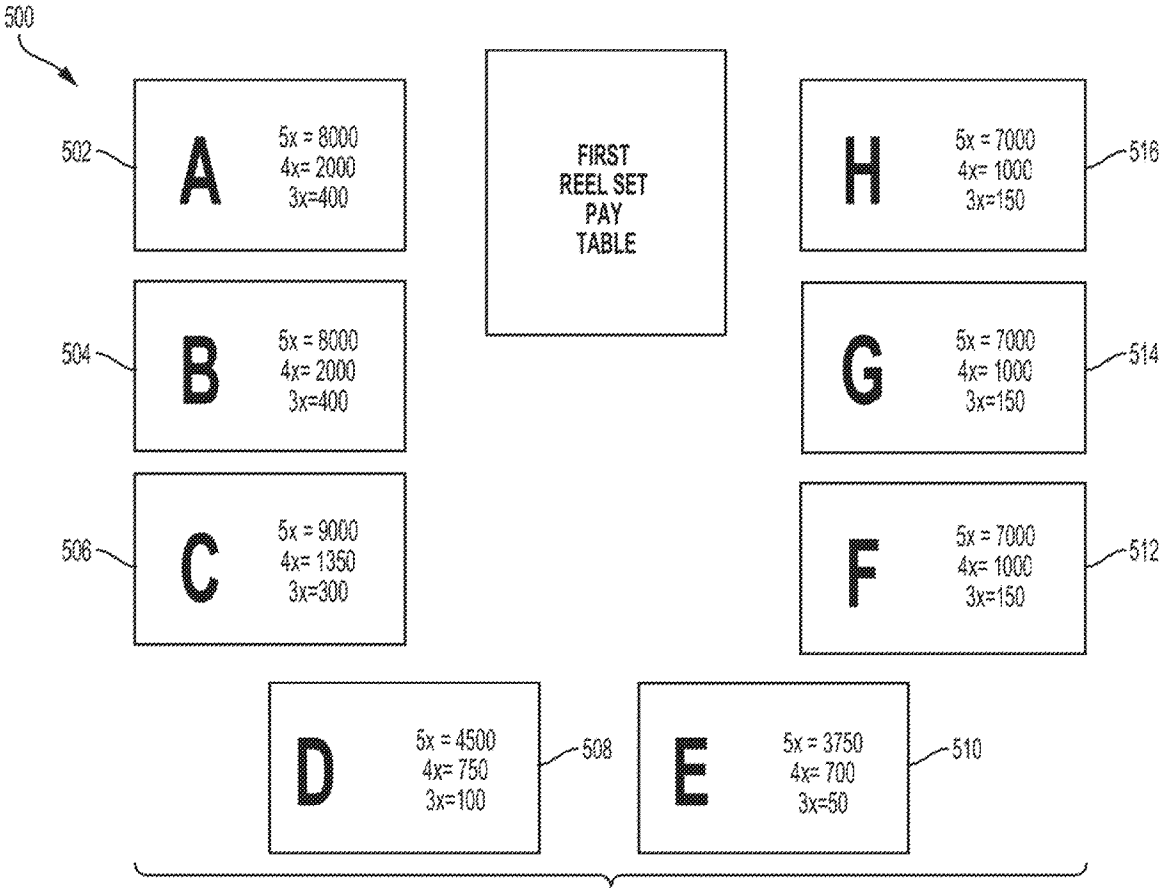
FIGS. 5A, 5B and 5C illustrate embodiments of pay tables in a gaming system having independent symbol sets that are interleaved, but can be evaluated separately and together.

FIG. 5A illustrates a screen shot of one embodiment of a pay table 500 for winning symbol combinations across wagered pay lines of the first set of reels. Tables 502, 504, 506, 508, 510, 512, 514, and 516 are merely example payout awards for example symbol combinations. As noted above, it should be appreciated that the pay table is merely illustrative, and the symbols, awards, and the credit values may all be modified in any suitable manner. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

Figure 5B:
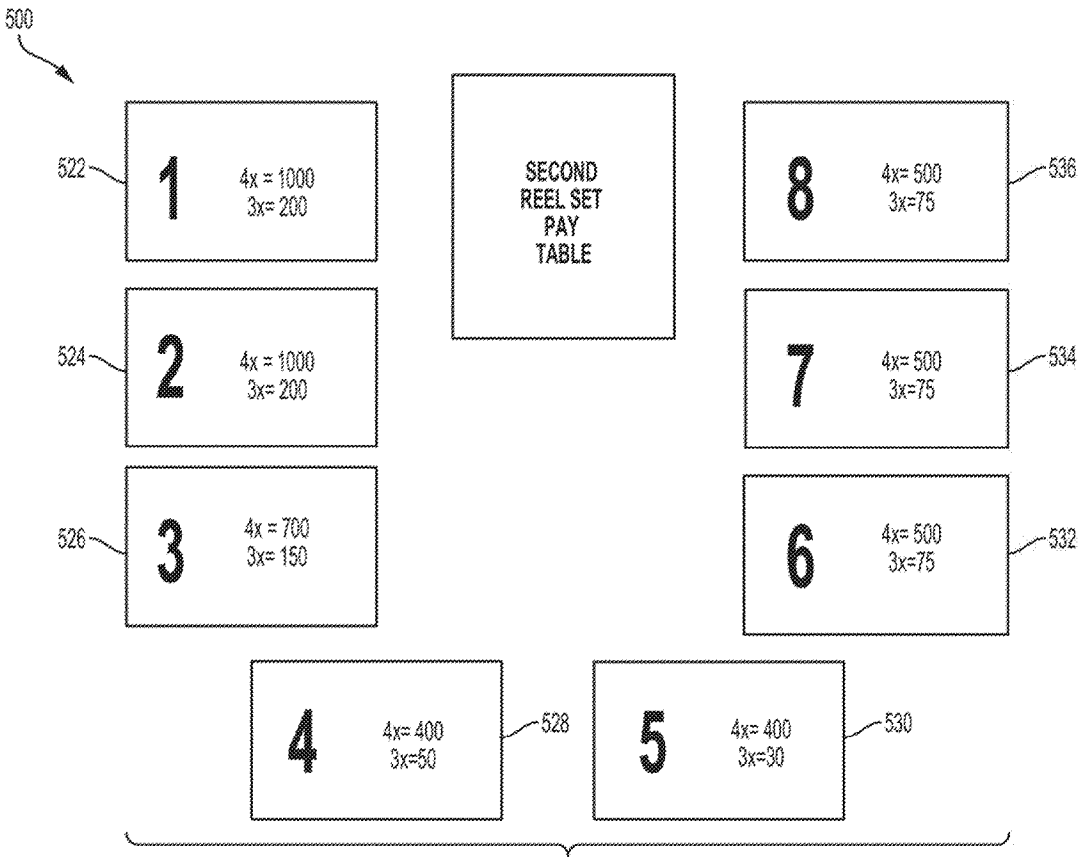

FIG. 5B illustrates a screen shot of one embodiment of a pay table 500 for winning symbol combinations across wagered pay lines of the second set of reels. Tables 522, 524, 526, 528, 530, 532, 534, and 536 are merely example payout awards for example symbol combinations. As noted above, it should be appreciated that the pay table is merely illustrative, and the symbols, awards, and the credit values may all be modified in any suitable manner. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

Figure 5C:
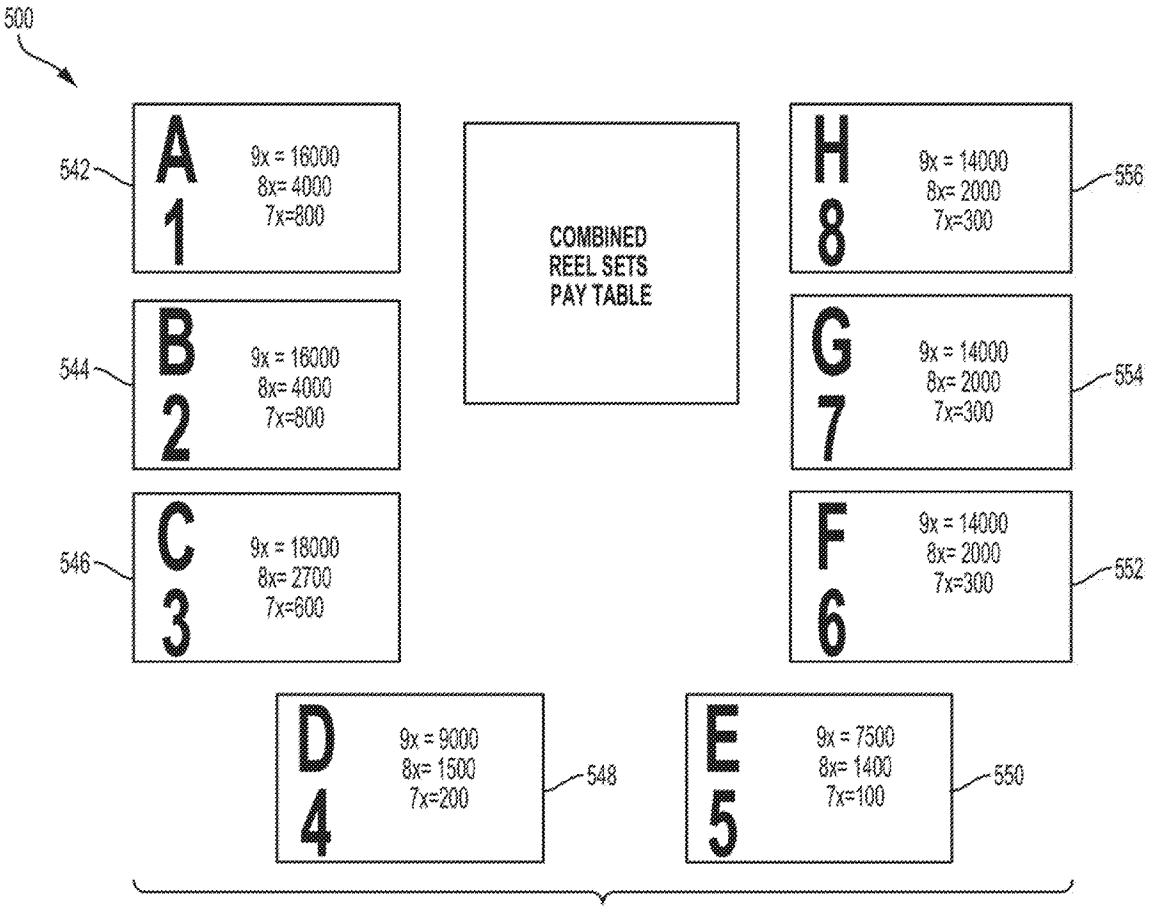

FIG. 5C illustrates a screen shot of one embodiment of a pay table 500 for winning symbol combinations across wagered pay lines of the combined first and second sets of reels. Tables 542, 544, 546, 548, 550, 552, 554, and 556 are merely example payout awards for example symbol combinations. As noted above, it should be appreciated that the pay table is merely illustrative, and the symbols, awards, and the credit values may all be modified in any suitable manner. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

Based on the above description, it should be appreciated that playing with a second independent set of reels enables a gaming system to provide numerous new and different ways to generate awards for players. Because the gaming system can evaluate the first set of reels and the second set of reels independently and together to determine game awards, the gaming system can be viewed as providing three or more different games as part of one play of the game. Thus, a player's one wager in some embodiments may enable the player to obtain awards associated with three different games. The new potential to earn new and greater awards creates a greatly improved sense of anticipation of the game for players.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

I claim:

1. A gaming system comprising:
- a cabinet;
- a processor;
- a display device supported by the cabinet;
- an input device supported by the cabinet;
- a value acceptor supported by the cabinet;
- a value dispenser supported by the cabinet;
- a memory device that stores a plurality of instructions which, when executed by the processor, cause the processor to:
  - establish a credit balance based at least in part on a monetary value received by the value acceptor;
  - place a wager following receipt of a wager input via an input device, the credit balance being decreased by the wager;
  - randomly generate a first plurality of symbols;
  - display, on the display device, the first plurality of symbols;
  - randomly generate a second plurality of symbols;
  - display, on the display device, the second plurality of symbols;
  - determine any awards based on symbol combinations from the first plurality of symbols;
  - determine any awards based on symbol combinations from the second plurality of symbols;
  - determine any awards based on symbol combinations from a combination of the first plurality of symbols and the second plurality of symbols;
  - display, on the display device, any determined awards and the credit balance being increased by any determined awards; and
  - issue value from the value dispenser based on the credit balance upon receipt of a cash out signal via the input device.

2. The gaming system of claim 1, wherein the processor further displays a first set of reels and a second set of reels, the first plurality of symbols are displayed on the first set of reels, and the second plurality of symbols are displayed on the second set of reels.

3. The gaming system of claim 2, wherein the first set of reels has a first number of reels, the second set of reels has a second number of reels, the first number of reels of the first set of reels is not the same as the second number of reels of the second set of reels.

4. The gaming system of claim 3, wherein the second number of reels of the second set of reels is one less than the first number of reels of the first set of reels.

5. The gaming system of claim 2, wherein displayed reels alternate between a reel of the first set of reels and a reel of the second set of reels.

6. The gaming system of claim 2, wherein each of the reels of the first set of reels is spaced from another reel of the first set of reels, at least a portion of one of the reels of the second set of reels is displayed between two reels of the first set of reels.

7. The gaming system of claim 6, wherein only a portion of one of the reels of the second set of reels is displayed between two reels of the first set of reels.

8. The gaming system of claim 2, wherein determination of at least one of the awards is based on a winning symbol combination, but not based on symbols of adjacent reels.

9. The gaming system of claim 8, wherein determination of at least one of the awards is based on symbols of adjacent reels.

10. The gaming system of claim 2, wherein the first set of reels has a first number of visible rows of symbols and the second set of reels has a second number of visible rows of symbols, the first number of visible rows of symbols of the first set of reels is not the same as the second number of visible rows of symbols of the second set of reels.

11. The gaming system of claim 10, wherein the visible rows of symbols of the first set of reels are offset from the visible rows of symbols of the second set of reels.

12. The gaming system of claim 1, wherein the first plurality of symbols are generated based on a first symbol set, the second plurality of symbols are generated based on a second symbol set, the first symbol set includes at least one symbol not in the second symbol set.

13. The gaming system of claim 12, wherein the symbol in the first symbol set, but not in the second symbol set, has an associated symbol in the second symbol set for determining an award.

14. The gaming system of claim 1, wherein the display of any determined awards includes the display of any determined awards based on the first plurality of symbols, the display of any determined awards based on the second plurality of symbols, and the display of any determined awards based on a combination of the first plurality of symbols and the second plurality of symbols.

15. The gaming system of claim 14, wherein the display of any determined awards displays a total of determined awards for any determined awards based on the first plurality of symbols, any determined awards based on the second plurality of symbols, and any determined awards based on a combination of the first plurality of symbols and the second plurality of symbols.

16. The gaming system of claim 1, wherein the processor determines any awards based on the second plurality of symbols where the processor further determines that a predetermined threshold wager has been received via the input device.

17. The gaming system of claim 1, wherein the processor determines any awards based on a combination of the first plurality of symbols and the second plurality of symbols where the processor determines that a predetermined threshold wager has been received via the input device.

18. The gaming system of claim 1, wherein the first plurality of symbols and the second plurality of symbols are disposed on a plurality of video based slot machine reels.

19. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

displaying a first set of randomly generated symbols;

displaying a second of randomly generated symbols;

generating any determined awards based on symbol combinations from the first set of randomly generated symbols;

generating any determined awards based on symbol combinations from the second set of randomly generated symbols;

generating any determined awards based on symbol combinations from a combination of the first set of randomly generated symbols and the second set of randomly generated symbols;

increasing, by the processor, the credit balance by any generated awards; and issuing any monetary value, by the value dispenser, based on the credit balance upon receipt of a cash out signal via an input device of the gaming system.

20. A non-transitory computer-readable storage medium having machine instructions stored therein, the instructions being executable by a processor to cause the processor to:

establish a credit balance based at least in part on a monetary value received by a value acceptor;

place a wager following receipt of a wager input via an input device, the credit balance being decreased by the wager;

randomly generate a first plurality of symbols;

display, on a display device, the first plurality of symbols;

randomly generate a second plurality of symbols;

display, on the display device, the second plurality of symbols;

determine any awards based on symbol combinations from the first plurality of symbols;

determine any awards based on symbol combinations from the second plurality of symbols;

determine any awards based on symbol combinations from the combination of the first plurality of symbols and the second plurality of symbols;

display, on the display device, any determined awards and the credit balance being increased by any determined awards; and issue value from a value dispenser based on the credit balance upon receipt of a cash out signal via the input device.

* * * * *